US011391508B2

(12) United States Patent
Eom et al.

(10) Patent No.: US 11,391,508 B2
(45) Date of Patent: Jul. 19, 2022

(54) REFRIGERATOR

(71) Applicant: SAMSUNG ELECTRONICS CO., LTD., Suwon-si (KR)

(72) Inventors: Tae-In Eom, Suwon-si (KR); Hyun Uk Park, Suwon-si (KR); Wan-Ku Kang, Suwon-si (KR); Chan Young Park, Suwon-si (KR); Young Kyun Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/720,997

(22) Filed: Dec. 19, 2019

(65) Prior Publication Data

US 2020/0200468 A1 Jun. 25, 2020

(30) Foreign Application Priority Data

Dec. 21, 2018 (KR) ..... 10-2018-0167388

(51) Int. Cl.
*F25D 25/02* (2006.01)
*A47B 96/02* (2006.01)

(52) U.S. Cl.
CPC ..... *F25D 25/024* (2013.01); *A47B 96/025* (2013.01); *A47B 96/028* (2013.01); *F25D 2325/021* (2013.01)

(58) Field of Classification Search
CPC ..... F25D 25/02; F25D 25/024; A47B 96/02; A47B 96/025; A47B 96/028
USPC ..... 312/401, 408, 298, 301, 310; 62/382
See application file for complete search history.

(56) References Cited

U.S. PATENT DOCUMENTS 542,277 A * 7/1895 Pauly, Sr.
5,813,741 A * 9/1998 Fish ..... F25D 25/024 108/108
8,936,332 B2 * 1/2015 Park ..... F25D 11/00 312/408

(Continued)

FOREIGN PATENT DOCUMENTS

EP 2728284 5/2014
JP 2002-199943 7/2002

(Continued)

OTHER PUBLICATIONS

International Search Report dated Apr. 22, 2020 in International Patent Application No. PCT/KR2019/018256.

(Continued)

*Primary Examiner* — James O Hansen
(74) *Attorney, Agent, or Firm* — Staas & Halsey LLP

(57) ABSTRACT

Provided is a refrigerator laving a shelf that ay be moved along at least two paths to improve accessibility to the shelf. The refrigerator includes a main body; and a storage chamber provided inside the main body to accommodate a shelf unit, wherein the shelf unit includes a first shelf arranged in a front portion of the storage chamber and moveable along a first direction relative to the storage chamber; a second shelf arranged behind the first shelf and moveable along the first direction relative to the storage chamber; and a guide unit arranged to guide the first shelf to be moved along a second direction relative to the storage chamber different from the first direction while the first shelf and the second shelf have been moved along the first direction.

7 Claims, 31 Drawing Sheets

(56) References Cited

U.S. PATENT DOCUMENTS

| | | | | |
|---|---|---|---|---|
| 9,803,915 | B2 | 10/2017 | Park et al. | |
| 9,803,916 | B2 | 10/2017 | Park et al. | |
| 2013/0020922 | A1* | 1/2013 | Jang | F25D 23/067 312/408 |
| 2014/0265799 | A1* | 9/2014 | Eichman | F25D 25/025 312/404 |
| 2014/0375199 | A1* | 12/2014 | Lee | F25D 25/024 312/404 |
| 2015/0153099 | A1* | 6/2015 | Nash | F25D 25/024 312/408 |
| 2016/0238307 | A1* | 8/2016 | Lee | F25D 25/027 |
| 2017/0314847 | A1* | 11/2017 | Ozyuksel | F25D 23/067 |

FOREIGN PATENT DOCUMENTS

| | | |
|---|---|---|
| KR | 20-0163781 | 2/2000 |
| KR | 10-2010-0028841 | 3/2010 |
| KR | 10-2012-0114610 | 10/2012 |
| KR | 10-2015-0142221 | 12/2015 |

OTHER PUBLICATIONS

Extended European Search Report dated Apr. 29, 2020 in European Patent Application No. 19219273.0.

* cited by examiner

REFRIGERATOR

CROSS-REFERENCE TO RELATED APPLICATION

This application is based on and claims priority under 35 U. S. C. § 119 to Korean Patent Application No. 10-2018-0167388 Filed on Dec. 21, 2018, the disclosure of which is incorporated herein by reference in its entirety.

BACKGROUND

1. Field

The present disclosure relates to a refrigerator having shelves enhanced to be easily accessible.

2. Description of Related Art

Refrigerators are home appliances equipped with a main body having a storage chamber, a cold air supplier for supplying cold air to the storage chamber and a door for opening or closing the storage chamber to keep food fresh.

A plurality of shelves are provided in the storage chamber to allow food items to be stacked and stored thereon.

When a shelf is fixed in the storage chamber, it is not easy for the user to access the shelf. For this reason, shelves that may be pulled out forward or folded in its front portion for easy access is used.

Although such shelves make it easy to access food kept thereon as compared with the fixed shelf in the storage chamber, reaching food stored in the back of the shelves still is not easy.

In addition, a rotary shelf may be provided to enable all food items stored thereon to be reachable always at the front of the shelf.

In this case, however, the rotary shelf needs a space for rotation, which may not be used to store food items and may take over the space for food storage.

SUMMARY

In accordance with an embodiment of the disclosure, a refrigerator includes a main body; and a storage chamber provided inside the main body to have an open front and a shelf unit, wherein the shelf unit includes a first shelf arranged in a front portion of the storage chamber to be moved forward or backward in the storage chamber; a second shelf arranged behind the first shelf; and a guide unit arranged to guide the first shelf to be moved to the left or right while the first and second shelves are moved forward.

The shelf unit may include a pair of first supporting members coupled onto either side on the bottom of the second shelf to support the first and second shelves from underneath the first and second shelves, and moved forward or backward along with the first and second shelves.

The shelf unit may include a plurality of second supporting members coupled onto the bottom of the first shelf to support the first shelf from underneath the first shelf, and moved to the left or right along with the first shelf.

The guide unit may include guides coupled onto a top surface of the back of the plurality of second supporting members, and guide rails arranged on the bottom of front portions of the first and second shelves to guide the guides to be moved left or right.

The guide rail arranged at the first shelf may include a catching bar arranged in a center portion of the guide rail to limit a distance moved by the guide to the left or right.

The shelf unit may include a pair of brackets coupled on either side of the first and second shelves to support the first and second shelves, and a pair of connecting rods coupled between the pair of brackets to prevent twisting of the first and second shelves.

The pair of connecting rods may include a first connecting rod coupled to back portions of the pair of brackets and a second connecting rod coupled to center portions of the pair of brackets.

The pair of first supporting members may be coupled with respective stoppers, the stoppers limiting a distance moved forward by the first and second shelves by being caught by the second connecting rod, so as for the first shelf to be moved to the left or right.

The bracket may include a sliding guide guiding the first and second shelves to be moved forward or backward, and the first and second shelves may include sliding rails arranged on either side of the first and second shelves to be moved forward or backward along with the sliding guide.

The bracket may include a guide guiding the first and second shelves to be moved forward or backward, and the first and second shelves may include guide rails arranged on either side of the first and second shelves for the guide to be moved forward or backward.

The shelf unit may include coupling members coupled onto either side on the bottom of the first shelf and including a guide unit coupler to which the guide unit is coupled.

The guide unit may include a first guide rail coupled to the guide unit coupler, and a second guide rail coupled onto the bottom of a front portion of the second shelf to guide the first guide rail to be moved left or right.

The guide unit may include a third guide rail arranged in a rear portion of the first shelf, and a guide arranged on a top surface of the front of the second shelf to guide the third guide rail to be moved left or right.

The shelf unit may include a pair of brackets coupled on either side of the first and second shelves to support the first and second shelves, and a pair of connecting rods coupled between the pair of brackets to prevent twisting of the first and second shelves.

The second shelf may be coupled with stoppers on either side on the bottom of the second shelf, the stoppers limiting a distance moved forward by the first and second shelves by being caught by one of the pair of connecting rods, which is in the front, so as for the first shelf to be moved to the left or right.

In accordance with another embodiment of the disclosure, a refrigerator including a main body; and a storage chamber provided inside the main body to have an open front and a shelf unit, wherein the shelf unit includes a first shelf arranged in a front portion of the storage chamber to be moved forward or backward in the storage chamber a second shelf arranged behind the first shelf to be moved forward or backward; a third shelf arranged next to the first and second shelves to be moved forward or backward in the storage chamber; and a guide unit arranged to guide the first shelf to be rotated to be in front of the third shelf while the first and second shelves are moved forward.

The guide unit may include a rotation shaft allowing the first shelf to be rotationally coupled with the second shelf, a coupler coupled onto the bottom of a front portion of the second shelf, a receiver rotationally receiving the rotation shaft, and a guide hole guiding the first shelf to be rotated around the rotation shaft.

The first shelf may include a guide projection protruding from the bottom of a rear portion of the first shelf to be inserted to the guide hole and guided along the guide hole, allowing the first shelf to be rotated around the rotation shaft.

The shelf unit may include a guide member including a stopper projection arranged to protrude from the bottom of a rear portion of the second shelf and a stopper projection guide hole, to which the stopper projection is inserted, guiding the first and second shelves to be moved forward or backward, the stopper projection guide hole limiting a distance moved forward by the stopper projection so as for the first shelf to be moved forward as far as the first shelf is able to rotate.

The shelf unit may include a fixing member coupled to the first shelf to be moved back and forth to fix the first shelf after the first shelf is rotated and located in front of the third shelf, and a fixing member fixing groove arranged at the front end of the third shelf for the fixing member to be inserted and fixed to the fixing member fixing groove.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
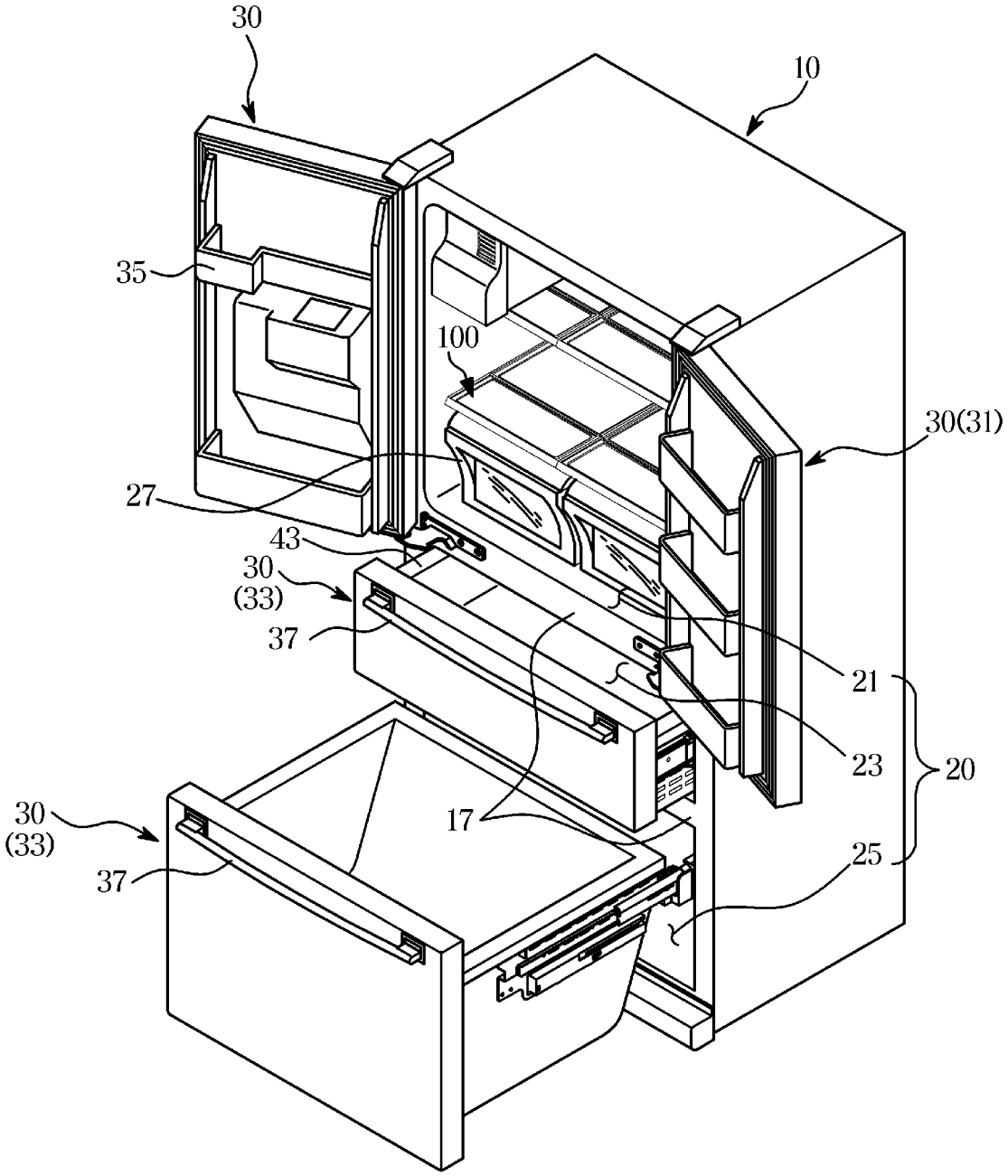
FIG. 1 is a perspective view of a refrigerator, according to an embodiment of the disclosure.

Embodiments and features as described and illustrated in the disclosure are merely examples, and there may be various modifications replacing the embodiments and drawings at the time of filing this application.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. For example, a first element could be termed a second element without departing from the scope of the disclosure. Descriptions shall be understood as to include any and all combinations of one or more of the associated listed items when the items are described by using the conjunctive term "~and/or~," or the like.

The terms "front", "rear", "upper", "lower", "top", and "bottom" as herein used are defined with respect to the drawings, but the terms may not restrict the shape and position of the respective components.

Embodiments of the present disclosure will now be described in detail with reference to accompanying drawings.

The disclosure provides a refrigerator having a shelf that may be moved along two paths to improve accessibility to the shelf.

FIG. 1 is a perspective view of a refrigerator, according to an embodiment of the disclosure.

Referring to FIG. 1, a refrigerator may include a main body 10, a storage chamber 20 with multiple chambers provided inside the main body 10 to have open front, and a door 30 to open or close the open front of the storage chamber 20.

The main body 10 may include an inner casing (not shown) defining the storage chamber 20, an outer casing (not shown) defining the exterior, and a cold air supply (not shown) for supplying cold air to the storage chamber 20.

The cold air supply may include a compressor (not shown), a condenser (not shown), an expansion valve (not shown), an evaporator (not shown), a blower fan (not shown), a cold air duct (not shown), etc., and there may be an insulation (not shown) foamed between the inner casing (not shown) and the outer casing (not shown) of the main body 10 to prevent the cold air from leaking out from the storage chamber 20. A machine room (not shown) where the compressor for compressing refrigerants and the condenser for condensing the compressed refrigerants are installed may be contained in a lower portion of the back of the main body 10.

The storage chamber 20 is divided by partition walls 17 into multiple chambers including a top chamber 21, a middle chamber 23, and a bottom chamber 25 from top to bottom, each chamber keeping groceries cool or frozen as required. The top chamber 21 may include a plurality of shelf units 100 to divide the top chamber 21 into multiple compartments, and a plurality of containers 27 to store groceries or some other items. The top chamber 1 may be opened or closed by a dual-type door 31 pivotally mounted on the main body 10, and the middle chamber 23 and the bottom chamber 25 may be opened or closed by a drawer-type door 33 that may slide against the main body 10.

The dual-type door 31 may include a plurality of door guards 35 on the rear side of the dual-type door 31 to contain food items. The drawer-type door 33 may include a handle 37 arranged on the front surface to be gripped by the user.

Figure 2:
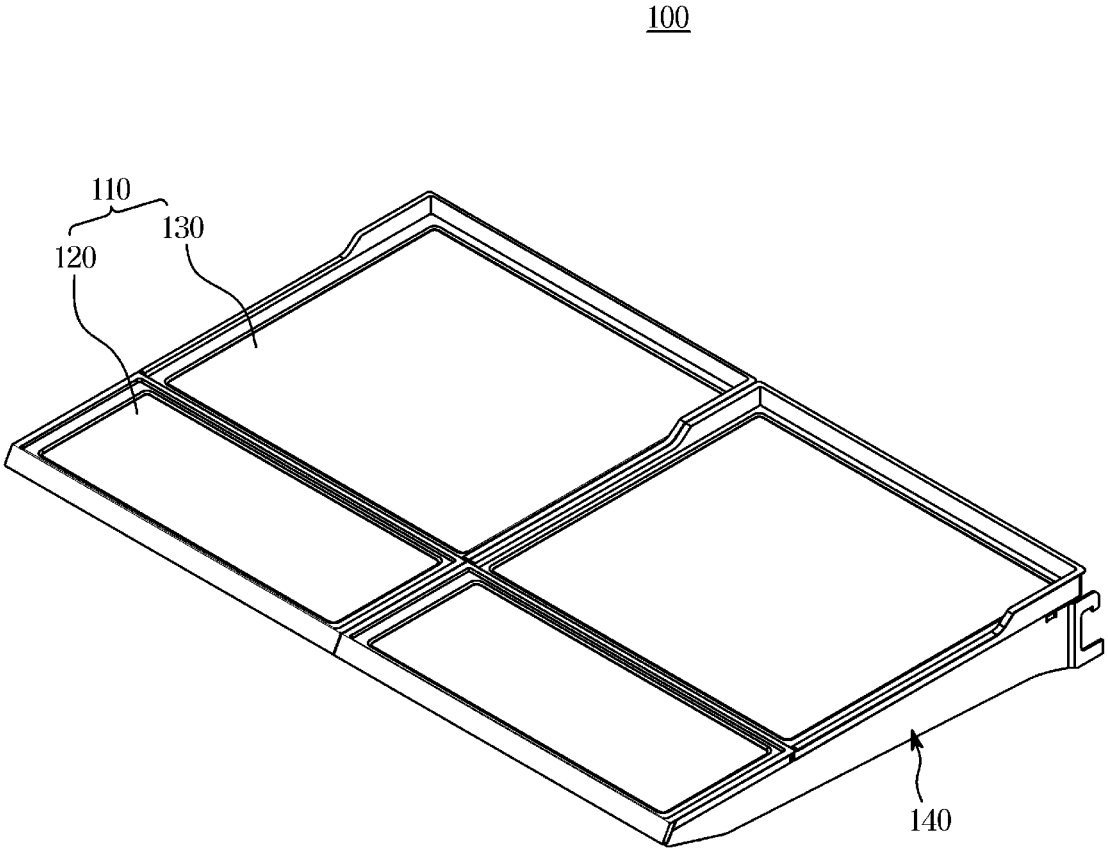
FIG. 2 is a perspective view of a shelf unit, according to an embodiment of the disclosure.
Figure 3:
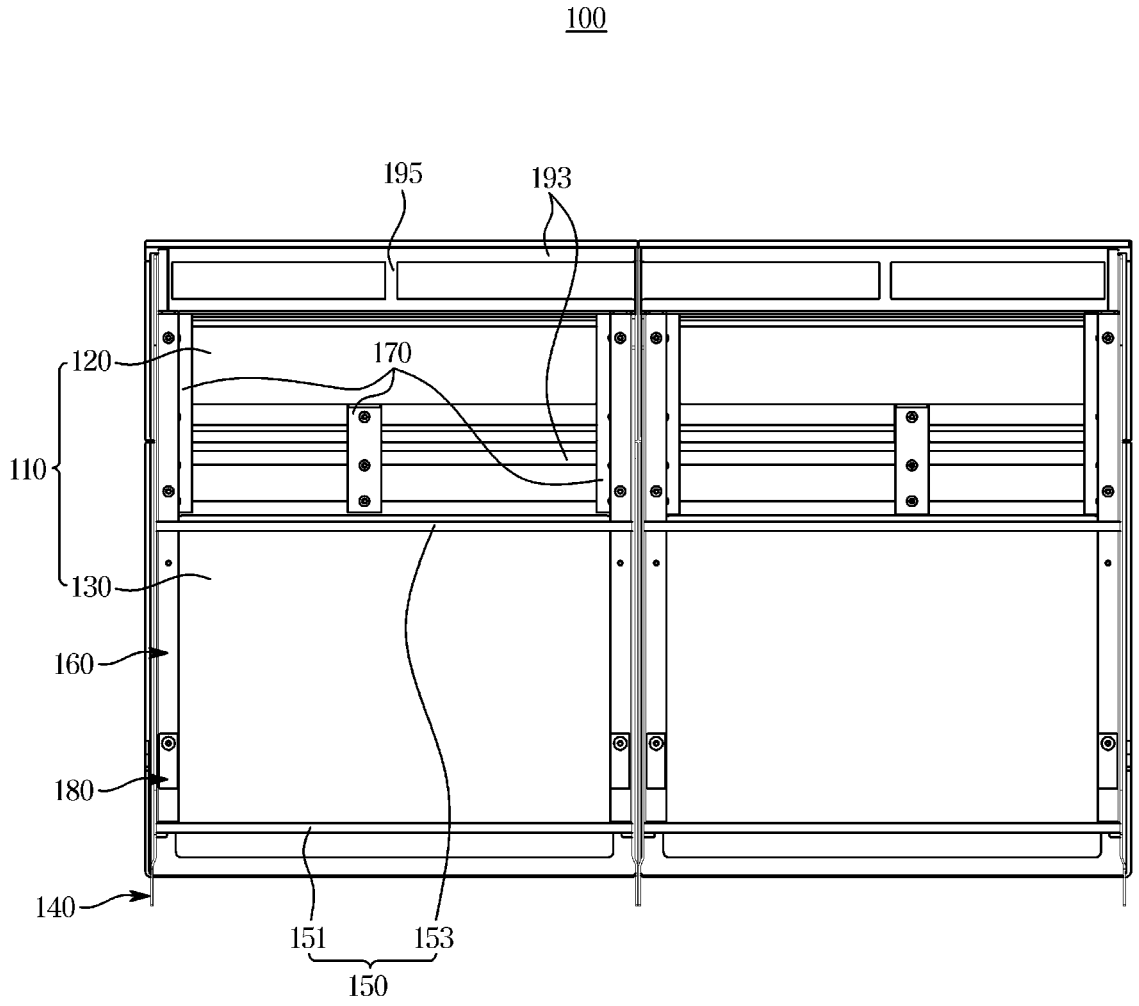
FIG. 3 is a plan view of the bottom of a shelf unit, according to an embodiment of the disclosure.
Figure 4:
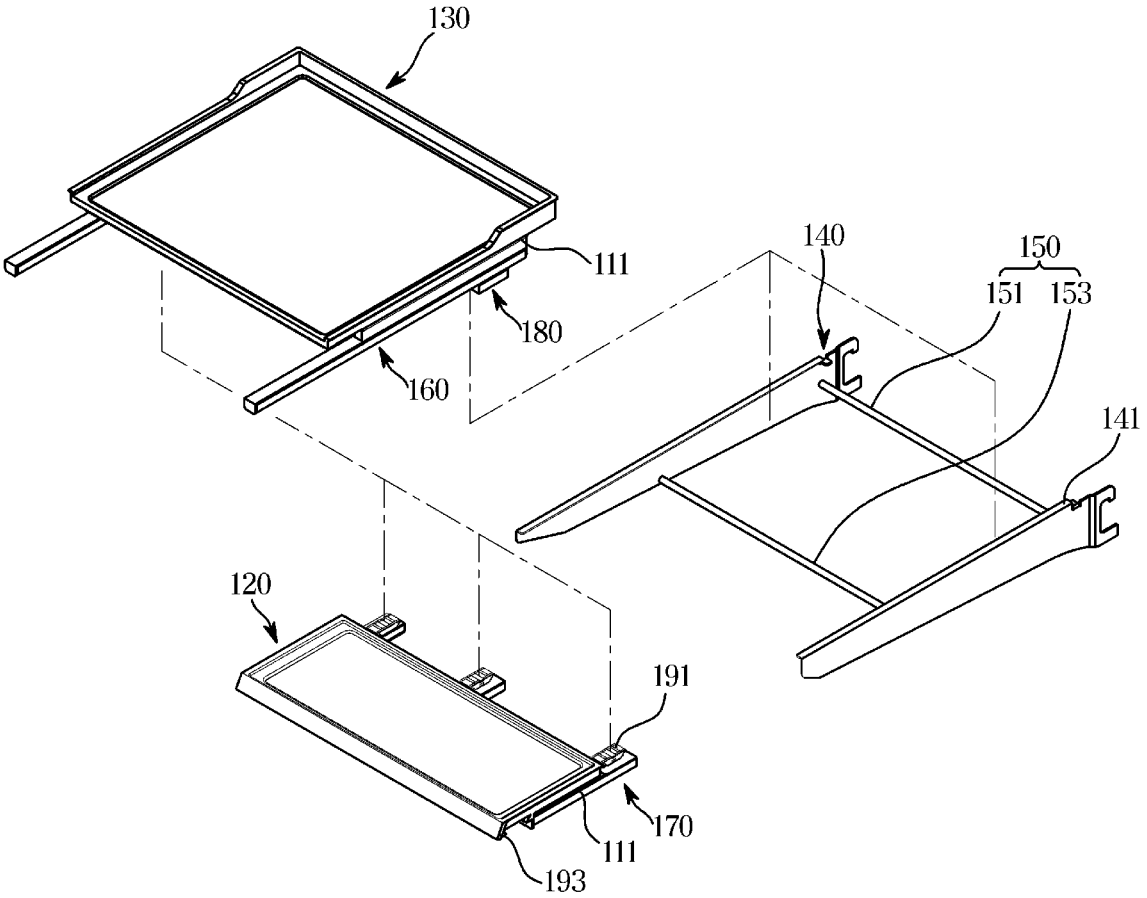
FIG. 4 is an exploded perspective view of a shelf unit, according to an embodiment of the disclosure.
Figure 5:
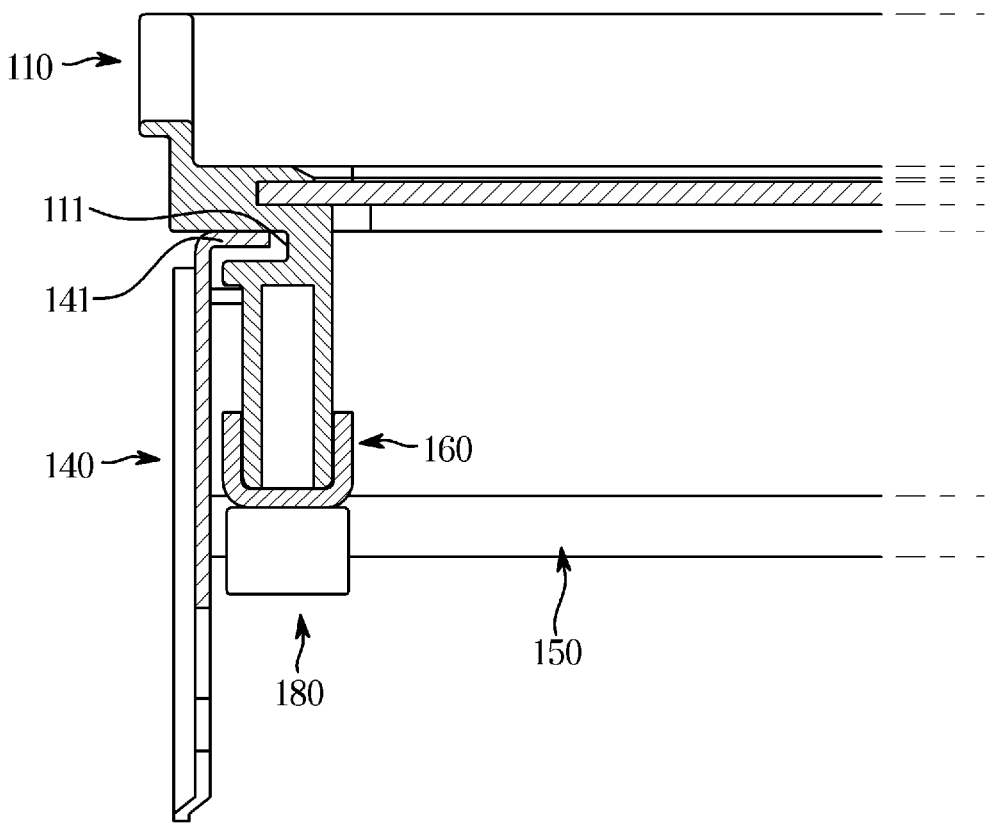
FIG. 5 is a cross-sectional view of a portion of a shelf unit, according to an embodiment of the disclosure.
Figure 6:
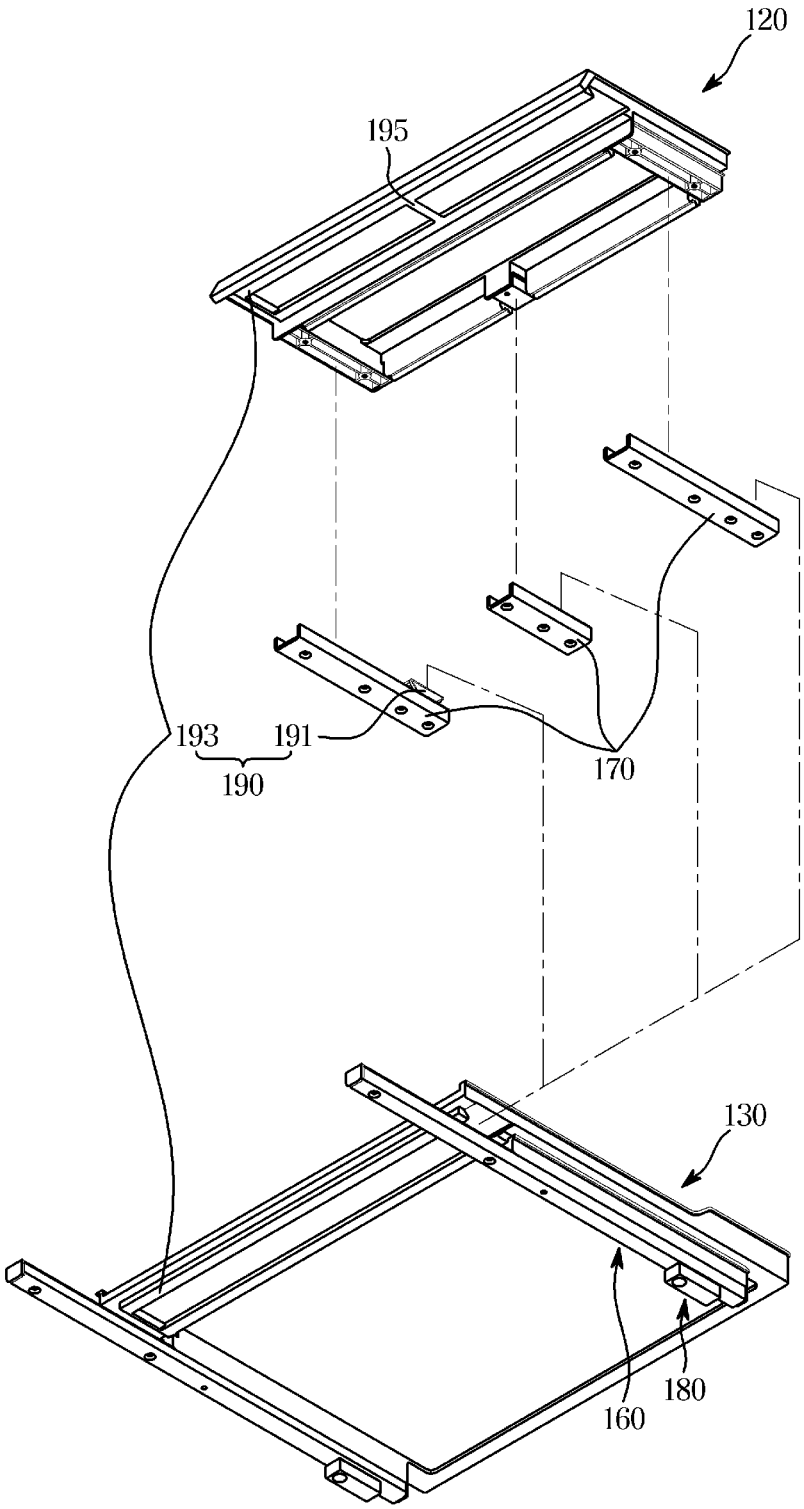
FIG. 6 is a view illustrating how a second support unit of a shelf unit is combined with a first shelf and a guide is combined with a guide rail, according to an embodiment of the disclosure.
Figure 7:
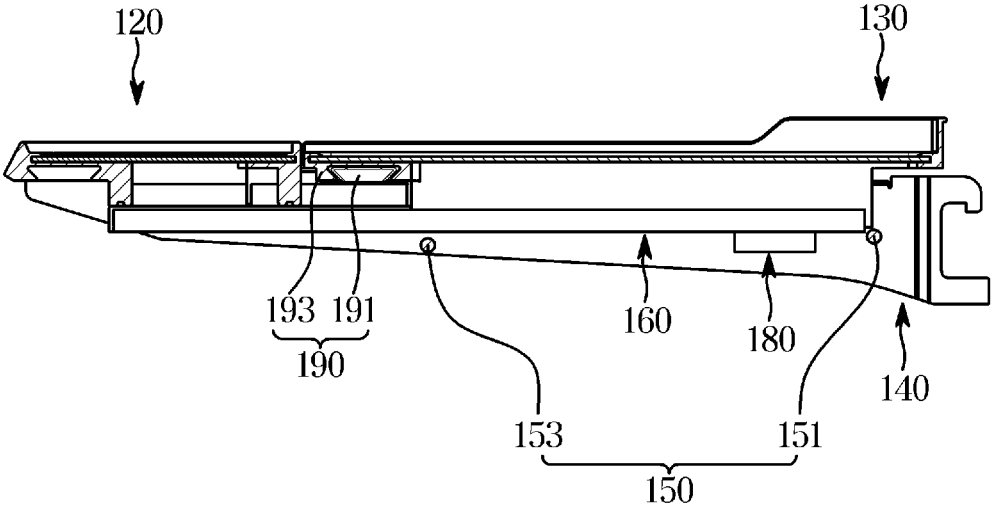
FIG. 7 is a side cross-sectional view of a shelf unit, according to an embodiment of the disclosure.

FIG. 2 is a perspective view of a shelf unit, according to an embodiment of the disclosure, FIG. 3 is a plan view of the bottom of a shelf unit, according to an embodiment of the disclosure, FIG. 4 is an exploded perspective view of a shelf unit, according to an embodiment of the disclosure, FIG. 5 is a cross-sectional view of a portion of a shelf unit, according to an embodiment of the disclosure, FIG. 6 is a view illustrating how a second support unit of a shelf unit is combined with a first shelf and a guide is combined with a guide rail, according to an embodiment of the disclosure, and FIG. 7 is a side cross-sectional view of a shelf unit, according to an embodiment of the disclosure.

Referring to FIGS. 2 to 7, a shelf unit 100 may include a pair of shelves 110 arranged on the left and right inside the storage chamber 20, and a pair of brackets 140 coupled onto either side of each of the shelves 110 to support the shelf 110 (see FIG. 1).

The pair of the shelves 110 provided on the left and right of the storage chamber 20 have the same structure, so hereinafter, only one of the shelves 110, e.g., the shelf 110 on the left of the storage chamber 20 will be brought to focus as an example.

The shelf 110 provided on the left or right of the storage chamber 20 may include a first shelf 120 arranged in the front and a second shelf 130 arranged behind the first shelf 120.

The brackets 140 may be coupled onto either side of the first and second shelves 120 and 130, in which case the bracket 140 coupled onto the left side of the first and second shelves 120 and 130 may be fixed to an inner wall of the storage chamber 20.

As for the shelf 110 provided on the right inside the storage chamber 20, the bracket 140 coupled onto the right side of the first and second shelves 120 and 130 may be fixed to an inner wall of the storage chamber 20.

The shelf 110 may be coupled with the brackets 140 to be moved forward or backward, allowing the user to easily take out a food item on the shelf 110.

The brackets 140 may include sliding guides 141 to guide the shelf 110 to be moved forward or backward. The shelf 110 may include sliding rails 111 arranged on either side of the shelf 110 and moved forward or backward along the sliding guides 141 of the brackets 140. The sliding guides 141 of the brackets 140 are received in sliding rails 111 arranged on either side of the shelf 110, and the shelf 110 array be moved forward or backward with the aid of the sliding rails 111 that are moved forward or backward along the sliding guides 141.

A pair of connecting rods 150 may be provided between the pair of brackets 140 coupled onto either side of the shelf 110. The pair of connecting rods 150 may prevent twisting of the shelf 110 when the shelf 110 is moved forward or backward. The pair of connecting rods 150 may include a first connecting rod 151 coupled onto back portions of the pair of brackets 140 and a second connecting rod 153 coupled onto center portions of the pair of the brackets 140.

The shelf unit 100 may include a pair of first supporting members 160 coupled to either side on the bottom of the second shelf 130 to support the shelf 110 from underneath the shelf 110. The first supporting members 160 coupled onto either side on the bottom of the second shelf 130 may extend forward from the second shelf 130 to support the bottom of the first shelf 120. The first supporting members 160 supporting the entire shelf 110 from underneath the shelf 110 may be moved forward or backward along with the shelf 110.

Stoppers 180 may be coupled onto the respective back portions of the pair of first supporting members 160. The stoppers 180 may limit a distance moved forward by the shelf 110 by being caught by the second connecting rod 153 while the shelf 110 is moving forward. The shelf 110 moving forward may be moved as far as the first shelf 120 is able to move to the left or right. While an example of the first shelf 120 is given as being forward or backward, and left or right, the present invention is not limited to any particular movement and can be moved in various directions.

After the shelf 110 is moved forward as far as the limited distance in the forward direction until the stopper 180 is caught by the second connecting rod 153, the first shelf 120 may be freely moved to the left or right.

The shelf unit 100 may include a plurality of second supporting members 170 coupled onto the bottom of the first shelf 120 to support the shelf 120. Although there are three second supporting members 170 shown in FIG. 3, embodiments of the disclosure are not limited thereto. The plurality of supporting members 170 may be moved to the left or right along with the first shelf 120.

The shelf unit 100 may include a guide unit 190 for the first shelf 120 to be moved to the left or right from the second shelf 130. The guide unit 190 may include guides 191 coupled onto the respective top surfaces in the back of the second supporting members 170, and guide rails 193 each provided on the bottom of the front of each of the first and second shelves 120 and 130 to guide the guide 191 to be moved to the left or right. The first and second shelves 120 and 130 may be coupled by the guide unit 190 and moved forward or backward together. The guide rails 193 may be provided on the respective front and bottom of the first and second shelves 120 and 130.

With this structure, when one of the left and right shelves in the storage chamber 20 is moved forward, the guide rail 193 provided on the front and bottom of the second shelf 130 of the shelf 110 and the guide rail 193 provided on the front and bottom of the first shelf 120 of the other shelf that is not moved forward may be connected (see FIG. 1).

When the guide rails 193 of the left and right shelves 110 are connected, the first shelf 120 of the shelf 110 that is moved forward may be moved to the left or right by the guide 191 guided to the left or right along with the guide rails 193.

Of the guide rails 193 provided on the respective front and bottom of the first and second shelves 120 and 130, the guide rail 193 on the front and bottom of the first shelf 120 may be provided with a catching bar 195. The catching bar 195 is provided in a center portion of the guide rail 193 to catch the guide 191 moving to the left or right, thereby limiting the motion of the guide 191. The distance moved by the first shelf 120 to the left or right may be limited.

Figure 8:
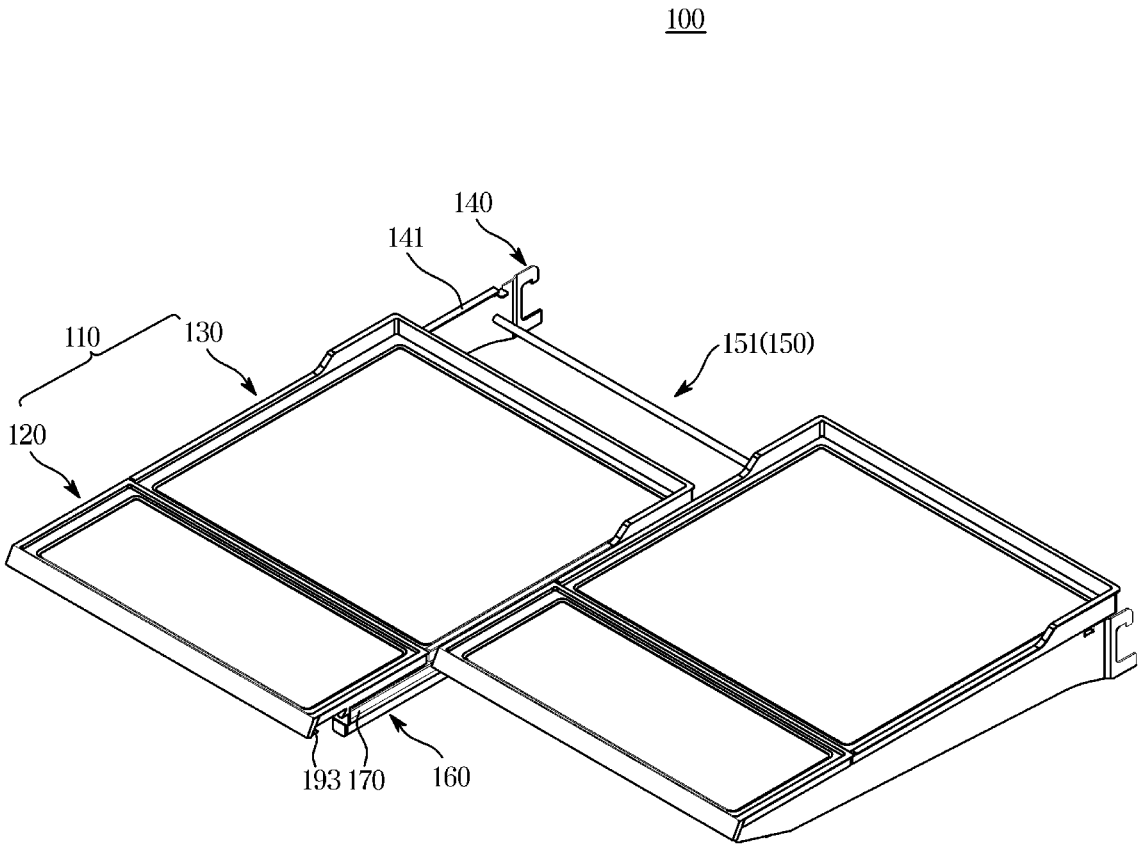
FIG. 8 shows a shelf unit with a left shelf moved forward, according to an embodiment of the disclosure.
Figure 9:
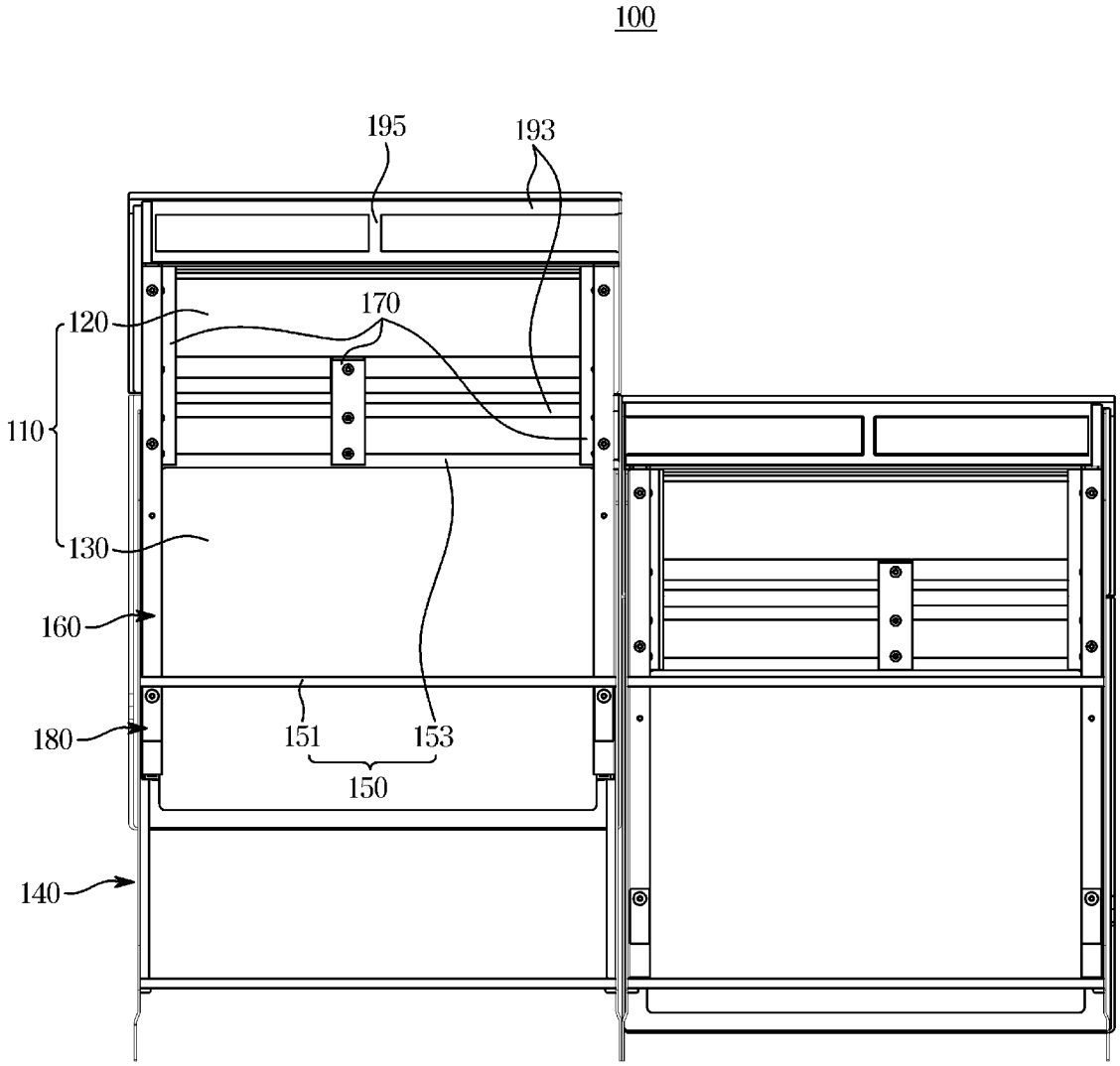
FIG. 9 is a plan view of the bottom of a shelf unit with a left shelf moved forward, according to an embodiment of the disclosure.

FIG. 8 shows a shelf unit with a left shelf moved forward, according to an embodiment of the disclosure, and FIG. 9 is a plan view of the bottom of a shelf unit with a left shelf moved forward, according to an embodiment of the disclosure.

Referring to FIGS. 8 and 9, the left shelf 110 may be moved forward with the aid of the sliding guides 141 arranged in the brackets 140 and the sliding rails 111 arranged on either side of the shelf 110 (also see FIG. 5).

The stoppers 180 may limit a distance moved forward by the shelf 110 by being caught by the second connecting rod 153 when the left shelf 110 is moved forward. When the left shelf 110 is moved forward as far as the distance limited by the stopper 180, the guide rail 193 arranged at the second shelf 130 of the left shelf 110 and the guide rail 193 arranged at the first shelf 120 of the right shelf 110 may be connected.

Figure 10:
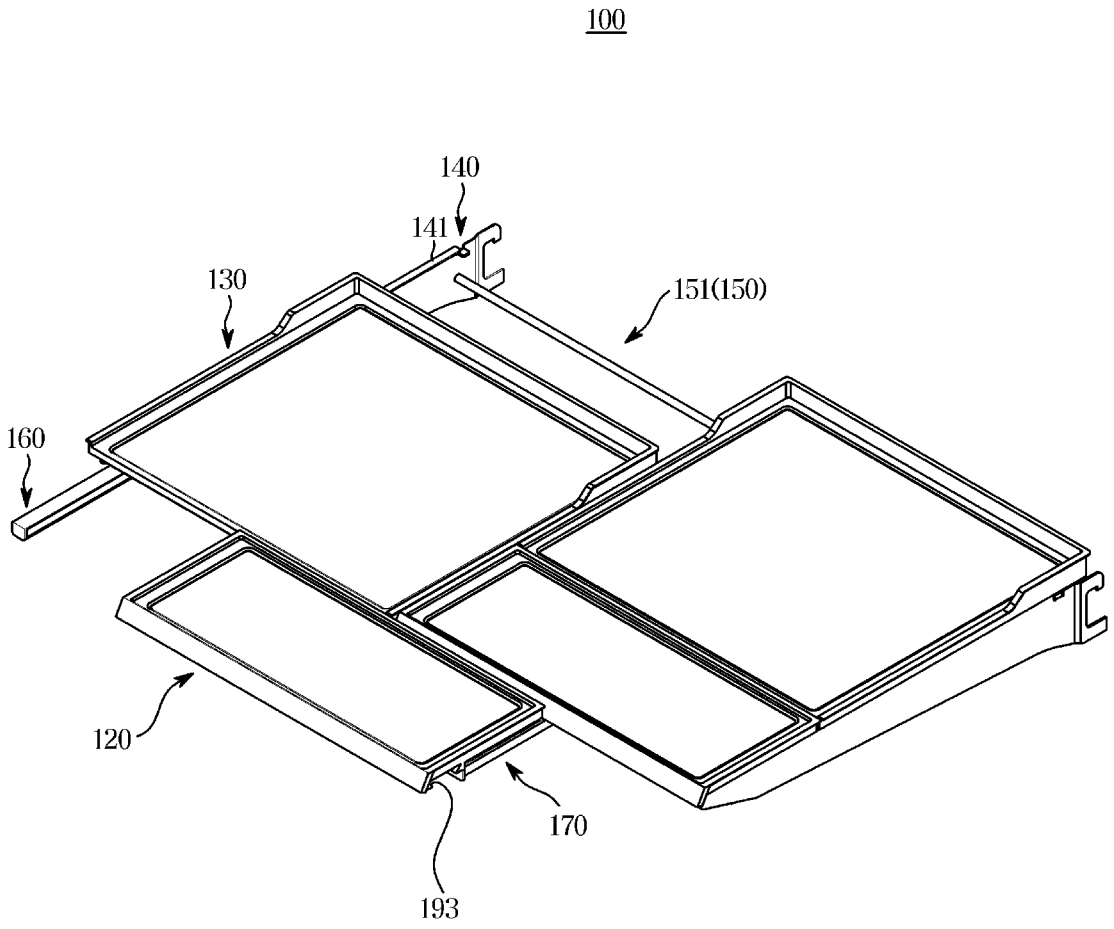
FIG. 10 shows a first shelf moved to the right from a left shelf moved forward, according to an embodiment of the disclosure.
Figure 11:
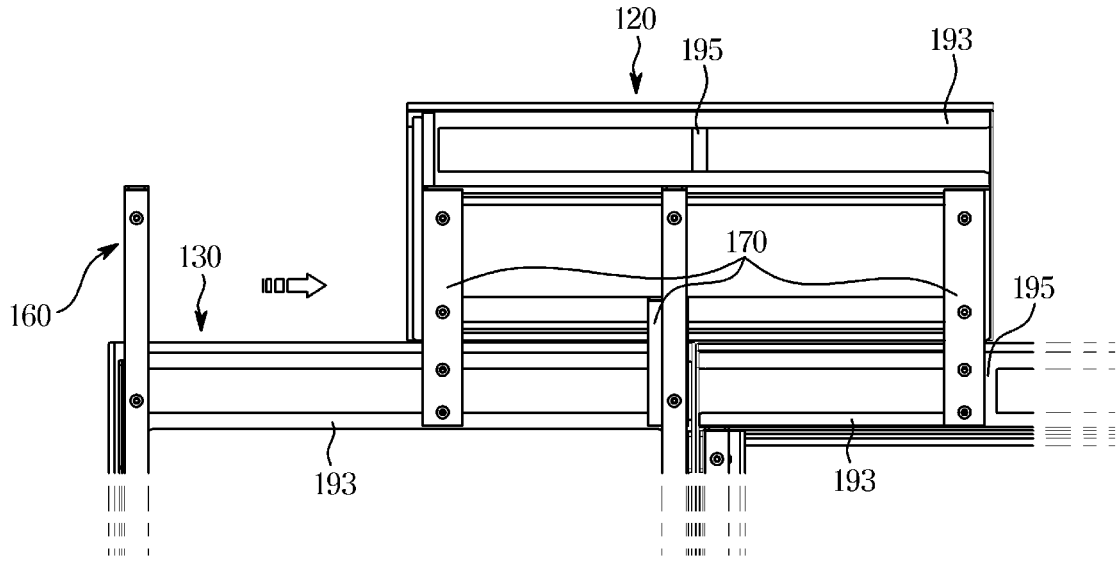
FIG. 11 is a plan view of the bottom of a shelf unit with a first shelf moved to the right from a left shelf moved forward, according to an embodiment of the disclosure.

FIG. 10 shows a first shelf moved to the right from a left shelf moved forward, according to an embodiment of the disclosure, and FIG. 11 is a plan view of the bottom of a shelf unit with a first shelf moved to the right from a left shelf moved forward, according to an embodiment of the disclosure.

Referring to FIGS. 10 and 11, the first shelf 120 of the left shelf 110 moved forward may be moved by the guide unit 190 to the right (also see FIG. 7). The guide 191 moved to the right along the connected guide rails 193 may be moved to the right by a limited distance by being caught by the catching bar 195. By moving the first shelf 120 of the left shelf 110 moved forward to the right, the user may easily reach and take oust a food item stacked and stored on the second shelf 130.

Figure 12:
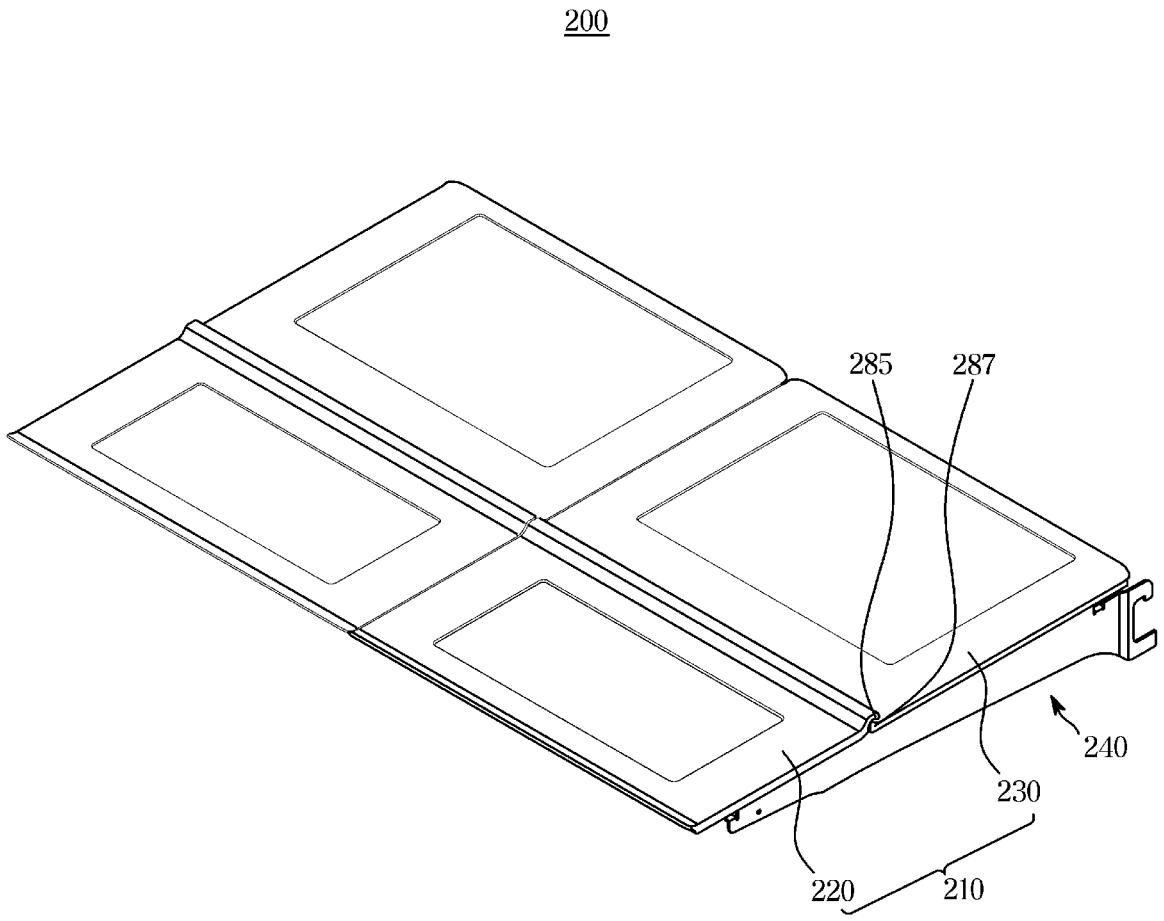
FIG. 12 is a perspective view of a shelf unit, according to another embodiment of the disclosure.
Figure 13:
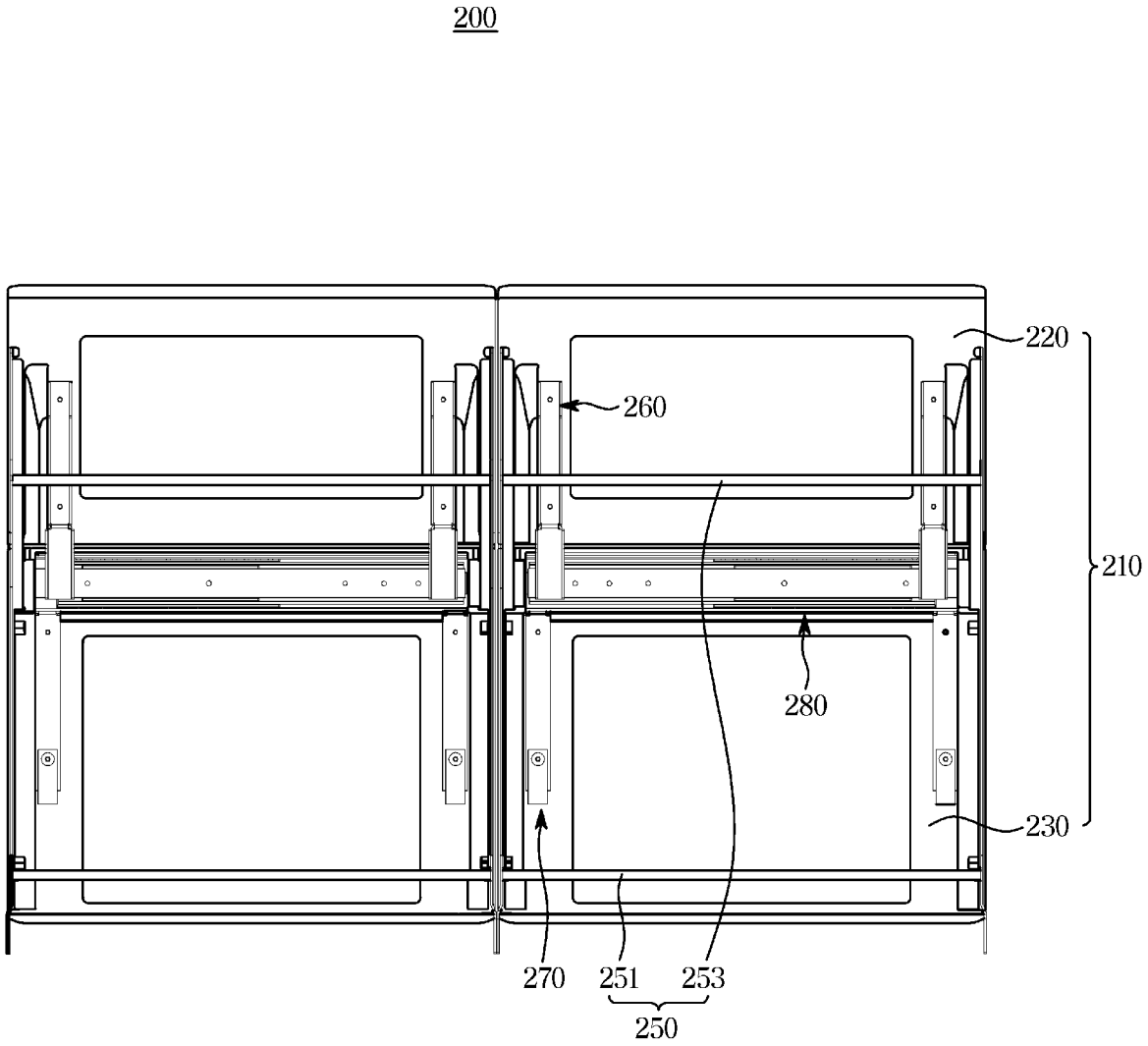
FIG. 13 is a plan view of the bottom of a shelf unit, according to another embodiment of the disclosure.
Figure 14:
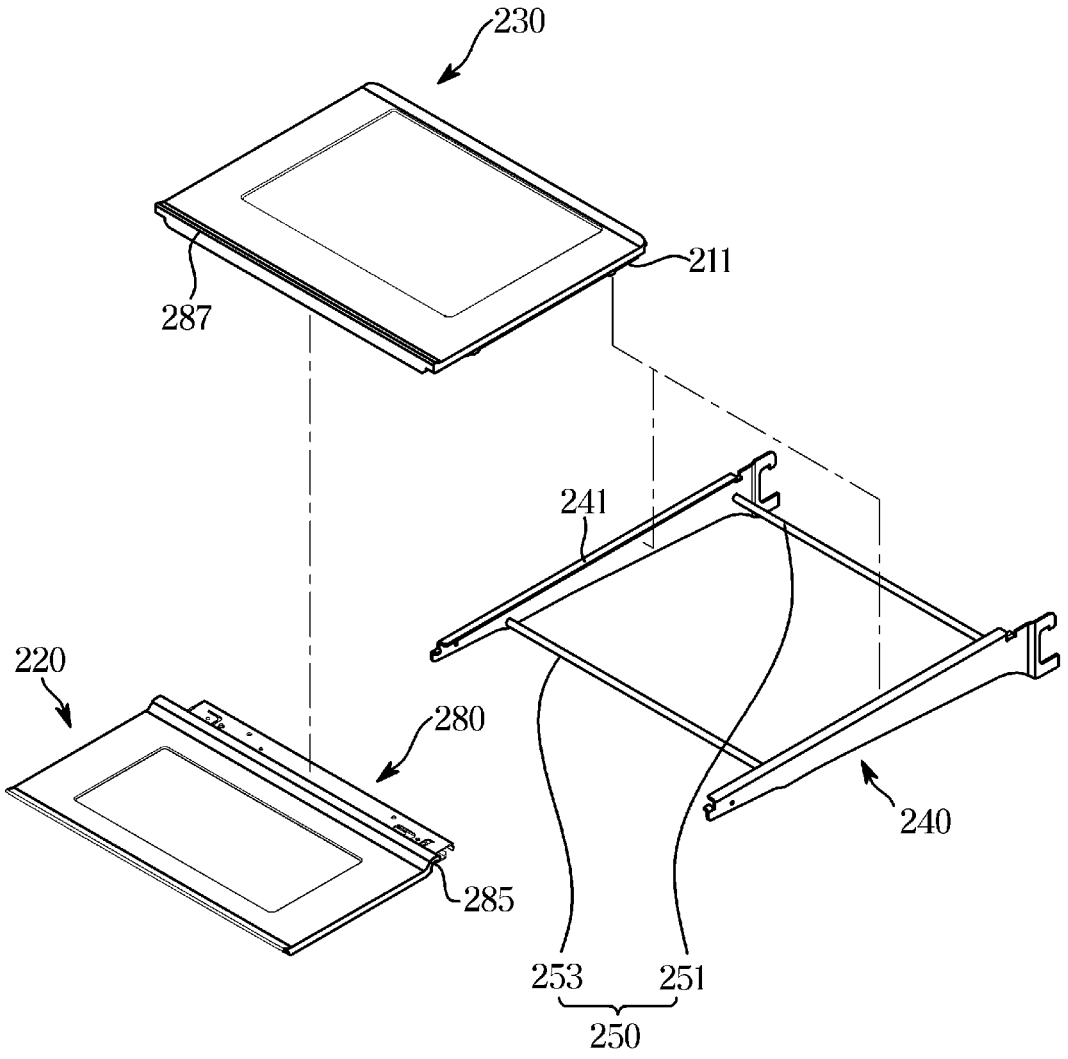
FIG. 14 is an exploded perspective view of a shelf unit, according to another embodiment of the disclosure.
Figure 15:
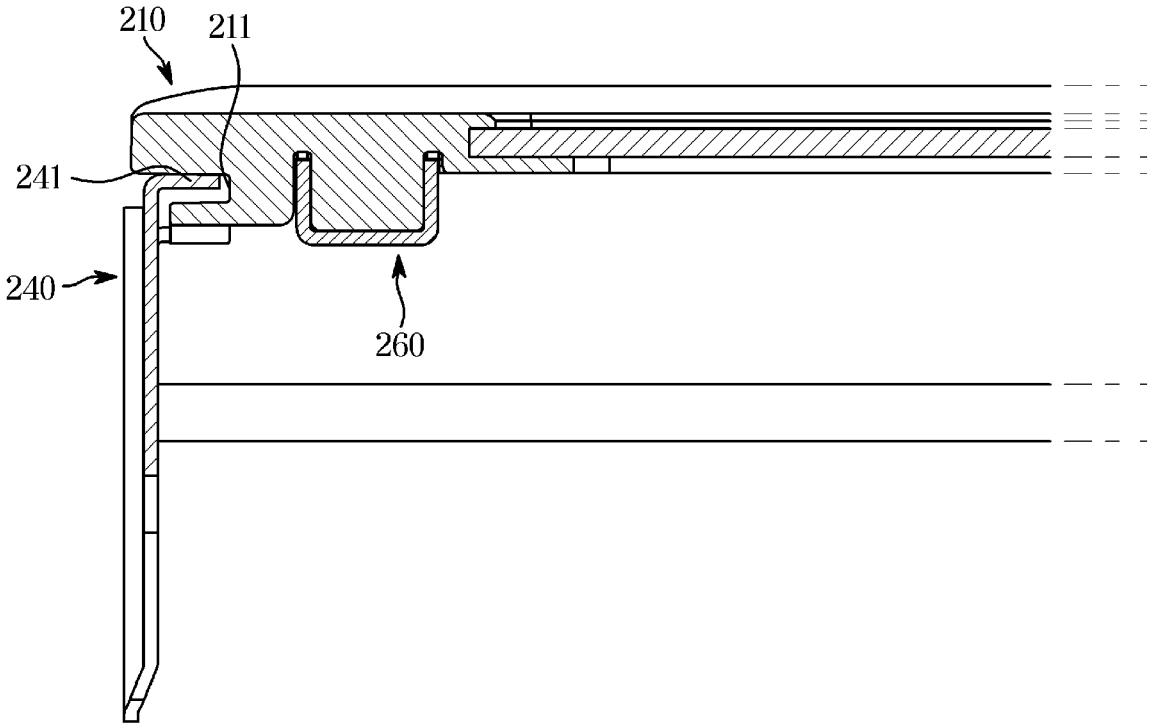
FIG. 15 is a cross-sectional view of a portion of a shelf unit, according to another embodiment of the disclosure.
Figure 16:
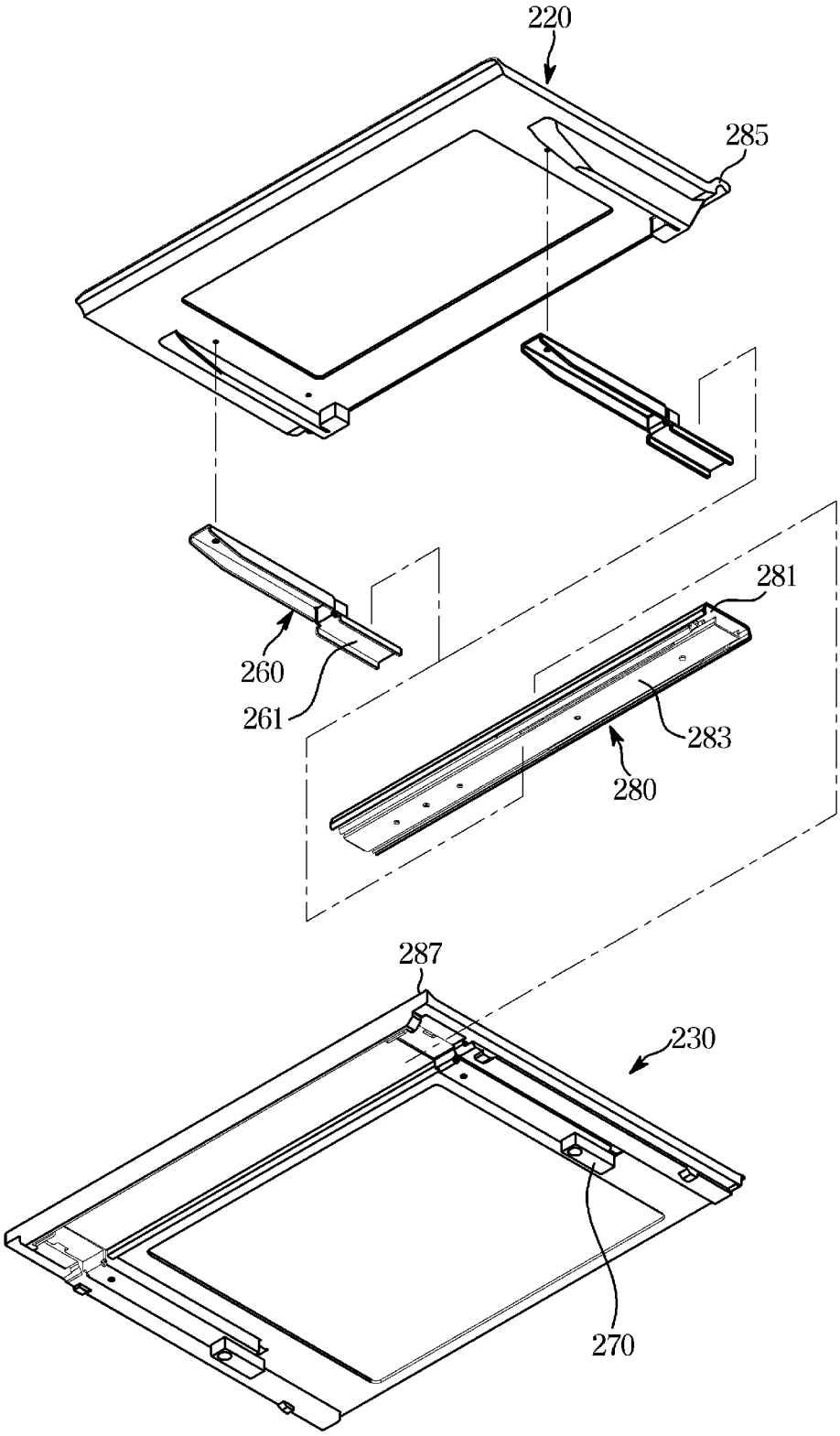
FIG. 16 shows a shelf unit with a guide unit and a coupling unit separated therefrom, according to another embodiment of the disclosure.
Figure 17:
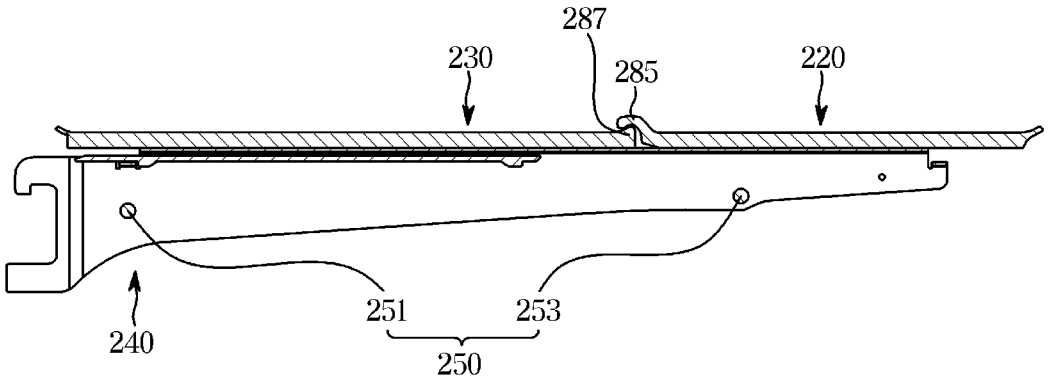
FIG. 17 is a side cross-sectional view of a shelf unit, according to another embodiment of the disclosure.

FIG. 12 is a perspective view of a shelf unit, according to another embodiment of the disclosure, FIG. 13 is a plan view of the bottom of a shelf unit, according to another embodiment of the disclosure, FIG. 14 is an exploded perspective view of a shelf unit, according to another embodiment of the disclosure, FIG. 15 is a cross-sectional view of a portion of a shelf unit, according to another embodiment of the disclosure, FIG. 16 shows a shelf unit with a guide unit and a coupling unit separated therefrom, according to another embodiment of the disclosure, and FIG. 17 is a side cross-sectional view of a shelf unit, according to another embodiment of the disclosure.

Referring to FIGS. 12 to 17, a shelf unit 200 may include a pair of shelves 210 arranged on the left and right inside the storage chamber 20, and a pair of brackets 240 coupled onto either side of each of the shelves 210 to support the shelf 210.

The pair of the shelves 210 provided on the left and right of the storage chamber 20 have the same structure, so hereinafter, only one of the shelves 210, e.g., the shelf 210 on the left of the storage chamber 20 will be brought to focus as an example.

Each shelf 210 provided on the left or right of the storage chamber 20 may include a first shelf 220 arranged in the front and a second shelf 230 arranged behind the first shelf 220.

Brackets 240 may be coupled onto either side of the first and second shelves 220 and 230, in which case the bracket 240 coupled onto the right side of the first and second shelves 220 and 230 may be fixed to an inner wall of the storage chamber 20. As for the shelf 210 provided on the left inside the storage chamber 20, the bracket 240 coupled onto the left side of the first and second shelves 220 and 230 may be fixed to an inner wall of the storage chamber 20.

The shelf 210 may be coupled with the brackets 240 to be moved forward or backward, allowing the user to easily take out a food item on the shelf 210.

The brackets 240 may include sliding guides 241 to guide the shelf 210 to be moved forward or backward. The shelf 210 may include sliding rails 211 arranged on either side of the shelf 210 and moved forward or backward along the sliding guides 241 of the brackets 240. The sliding guides 241 of the brackets 240 are received in sliding rails 211 arranged on either side of the shelf 210, and the shelf 210 may be moved forward or backward with the aid of the sliding rails 211 that are moved forward or backward along the sliding guides 241.

A pair of connecting rods 250 may be provided between the pair of brackets 240 coupled onto either side of the shelf 210. The pair of connecting rods 250 may prevent twisting of the shelf 210 when the shelf 210 is moved forward or backward. The pair of connecting rods 250 may include a first connecting rod 251 coupled onto back portions of the pair of brackets 240 and a second connecting rod 253 coupled to the pair of brackets 240 in front of the first connecting rod 251.

The shelf unit 200 may include coupling members 260 coupled onto either side on the bottom of the first shelf 220. A front portion of the coupling member 260 may be coupled onto the bottom of the first shelf 220 and a rear portion of the coupling member 260 may extend to the bottom of the second shelf 230. The coupling member 260 may include a guide unit coupler 261 arranged in the rear portion extending to the bottom of the second shelf 230 to be coupled with a guide unit 280 which will be described later.

Stoppers 270 may be coupled onto the back portions of both sides of the second shelf 230. The stoppers 270 may limit a distance moved forward by the shelf 210 by being caught by the second connecting rod 253 while the shelf 210 is moving forward. The shelf 210 moving forward may be moved as far as the first shelf 220 is able to move to the left or right. After the shelf 210 is moved forward as far as the limited distance in the forward direction until the stopper 270 is caught by the second connecting rod 253, the first shelf 220 may be freely moved to the left or right.

The shelf unit 200 may include the guide unit 280 for the first shelf 220 to be moved to the left or right from the second shelf 230. The guide unit 280 may include a first guide rail 281 coupled to the guide unit coupler 261 of the coupling member 260 and a second guide rail 283 coupled onto the bottom of the front portion of the second shelf 230. The first guide rail 281 may be movable in the left-right direction along the second guide rail 283. Accordingly, the first shelf 220 may be moved by the guide unit 280 to the left and right from the second shelf 230.

The guide unit 280 may include a third guide rail 285 arranged on the rear of the first shelf 220, and a guide 287 arranged on the top surface of the front of the second shelf 230 to guide the third guide rail 285 to be moved to the left or right. The first and second shelves 220 and 230 may be coupled by the guide unit 280. As the first and second shelves 220 and 230 may be coupled by the guide unit 280, they may be moved forward or backward together.

Figure 18:
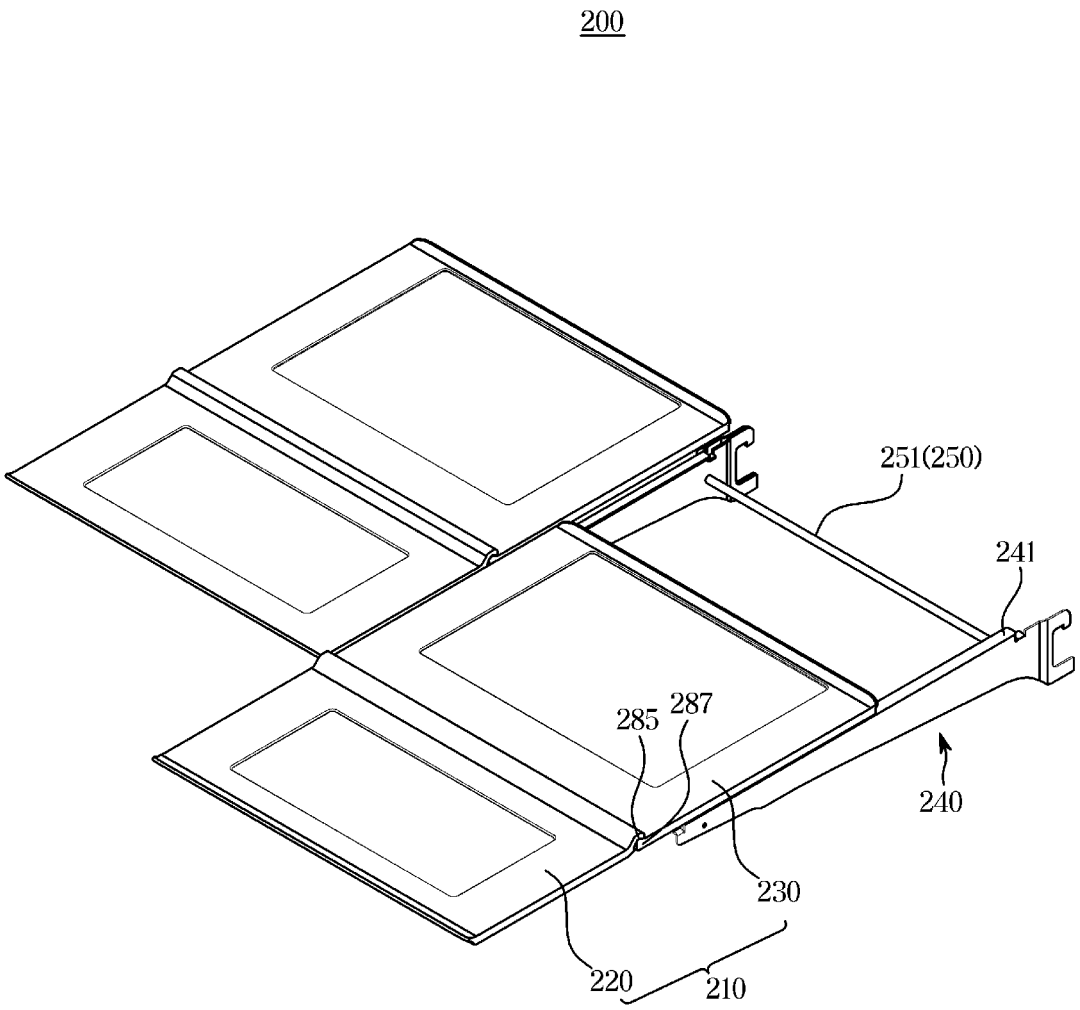
FIG. 18 shows a shelf unit with a right shelf moved forward, according to another embodiment of the disclosure.
Figure 19:
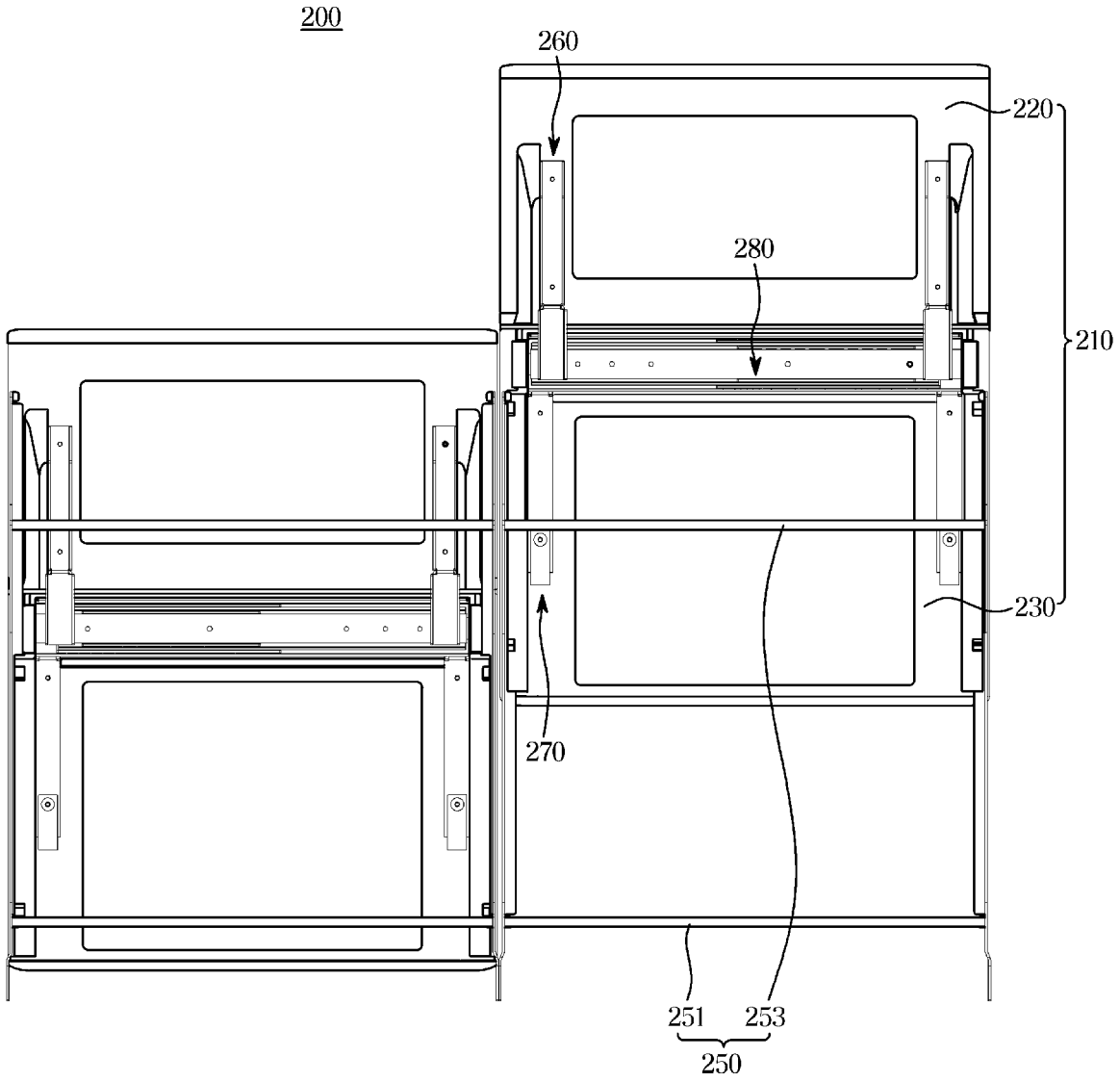
FIG. 19 is a plan view of the bottom of a shelf unit with a right shelf moved forward, according to another embodiment of the disclosure.

FIG. 18 shows a shelf unit with a right shelf moved forward, according to another embodiment of the disclosure, and FIG. 19 is a plan view of the bottom of a shelf unit with a right shelf moved forward, according to another embodiment of the disclosure.

Referring to FIGS. 18 and 19, the right shelf 210 may be moved forward with the aid of the sliding guides 241 arranged in the brackets 240 and the sliding rails 211 arranged on either side of the shelf 210 (also see FIG. 15).

The stoppers 270 may limit a distance moved forward by the shelf 210 by being caught by the second connecting rod 253 when the right shelf 210 is moved forward. When the right shelf 210 is moved forward as far as the distance limited by the stopper 270, the first shelf 220 of the right shelf 210 may be in a position to be freely moved to the left.

Figure 20:
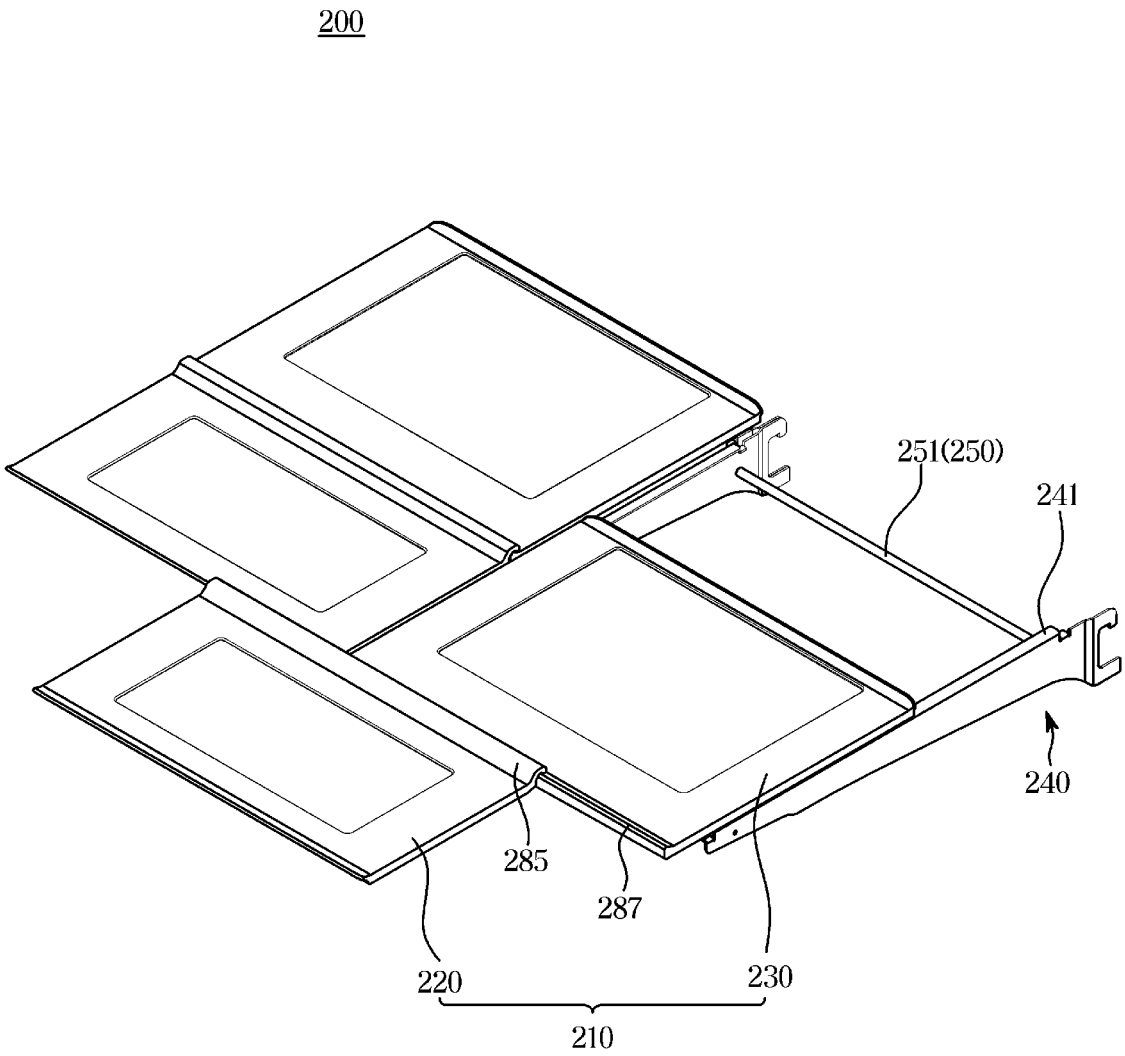
FIG. 20 shows a first shelf moved to the left from a right shelf moved forward, according to another embodiment of the disclosure.
Figure 21:
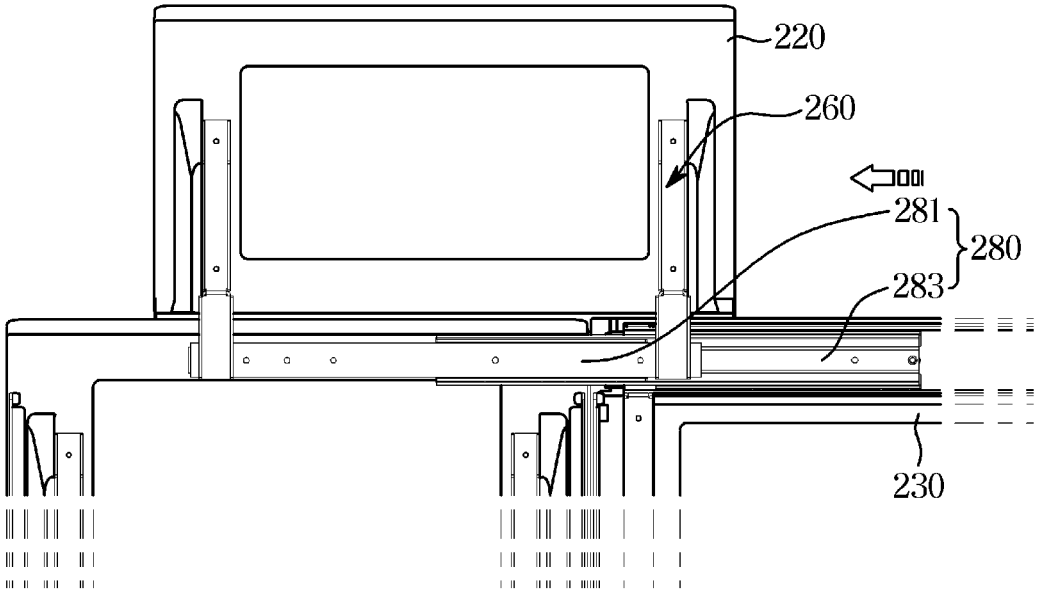
FIG. 21 is a plan view of the bottom of a shelf unit with a first shelf moved to the left from a right shelf moved forward, according to another embodiment of the disclosure.

FIG. 20 shows a first shelf moved to the left from a right shelf moved forward, according to another embodiment of the disclosure, and FIG. 21 is a plan view of the bottom of a shelf unit with a first shelf moved to the left from a right shelf moved forward, according to another embodiment of the disclosure.

Referring to FIGS. 20 and 21, the first shelf 220 of the right shelf 210 moved forward may be moved by the guide unit 280 to the left (also see FIG. 16).

By moving the first shelf 220 of the right shelf 210 moved forward to the left, the user may easily reach and take out a food item stacked and stored on the second shelf 230.

Figure 22:
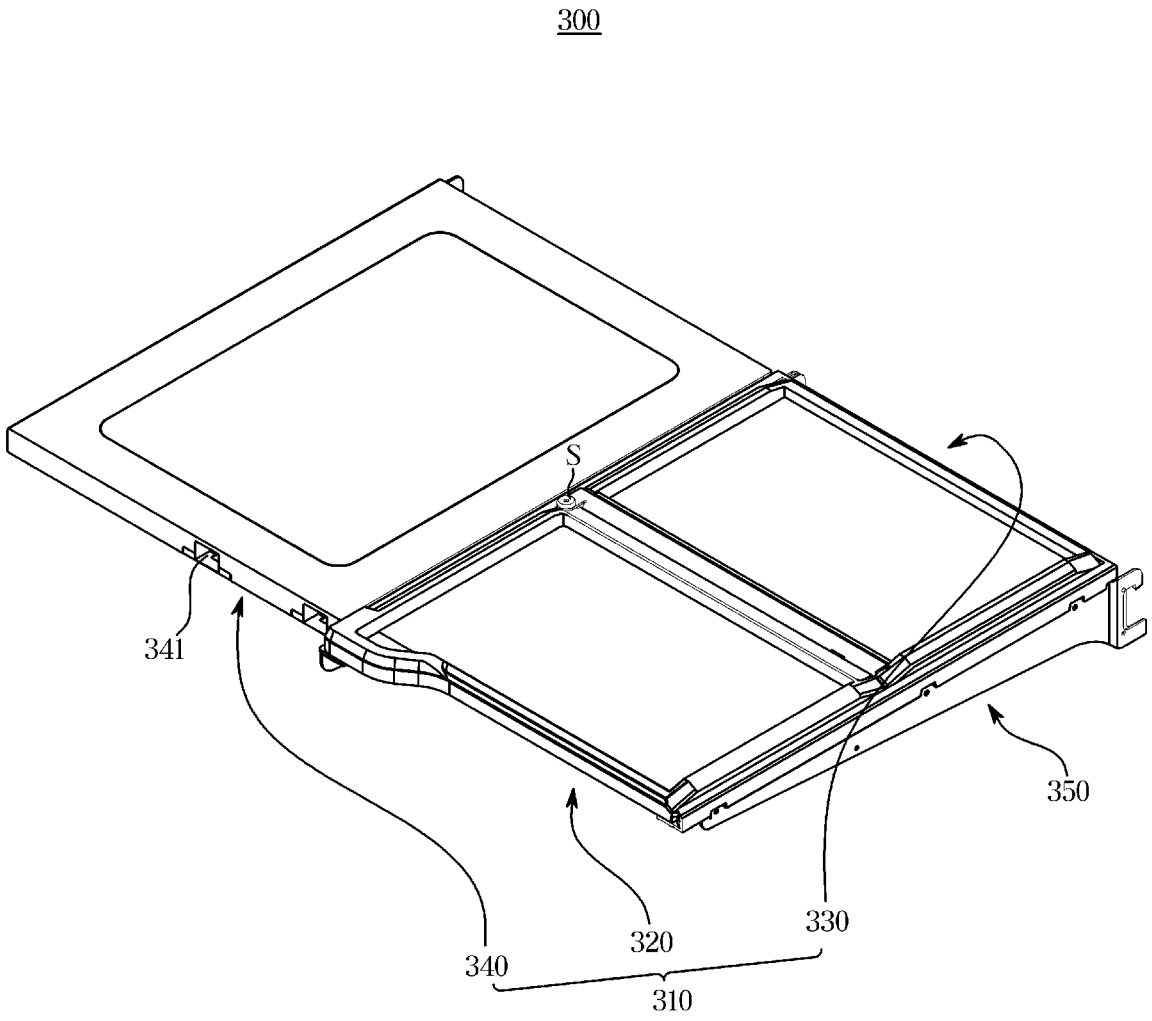
FIG. 22 is a perspective view of a shelf unit, according to another embodiment of the disclosure.
Figure 23:
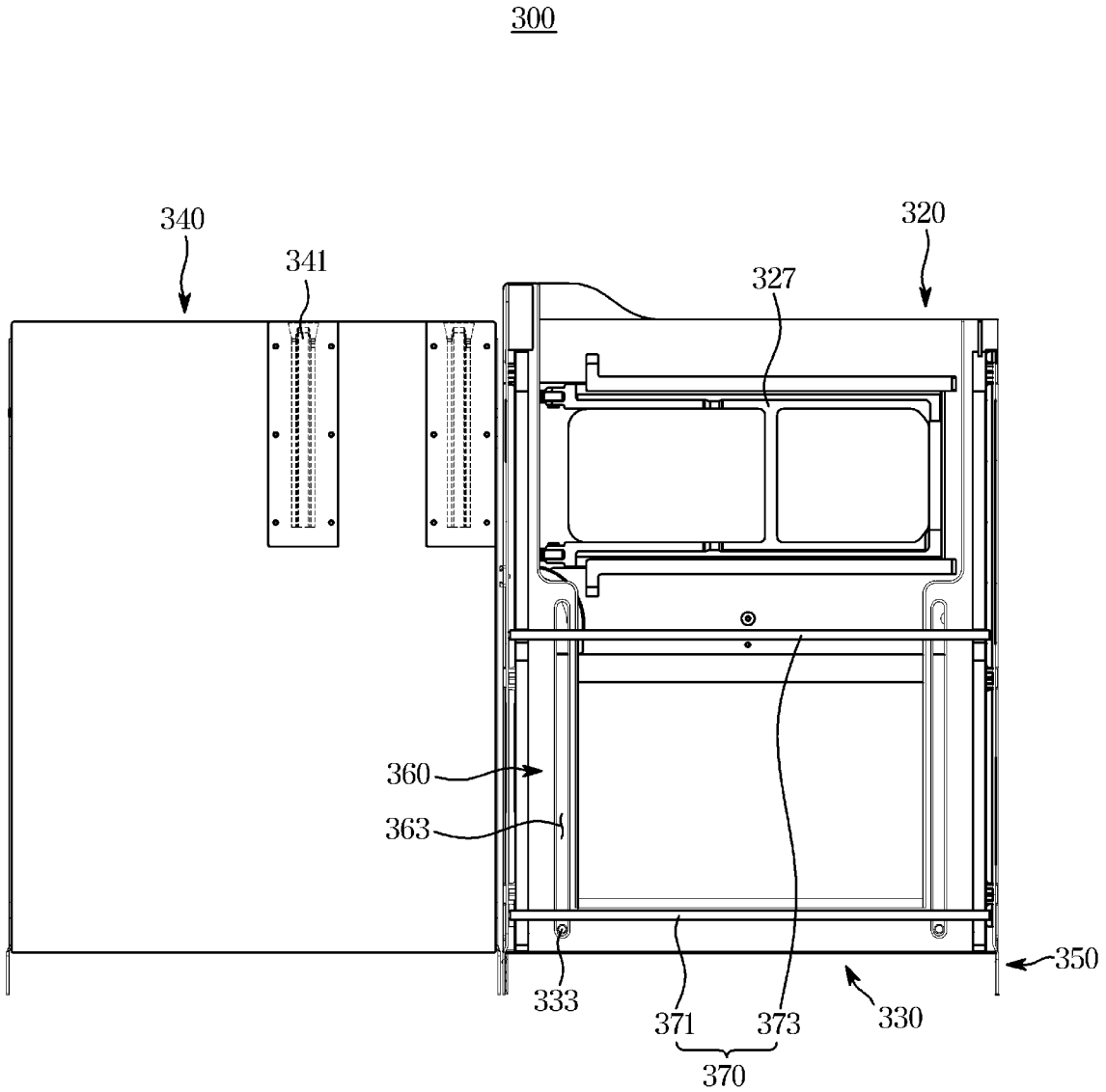
FIG. 23 is a plan view of the bottom of a shelf unit, according to another embodiment of the disclosure.
Figure 24:
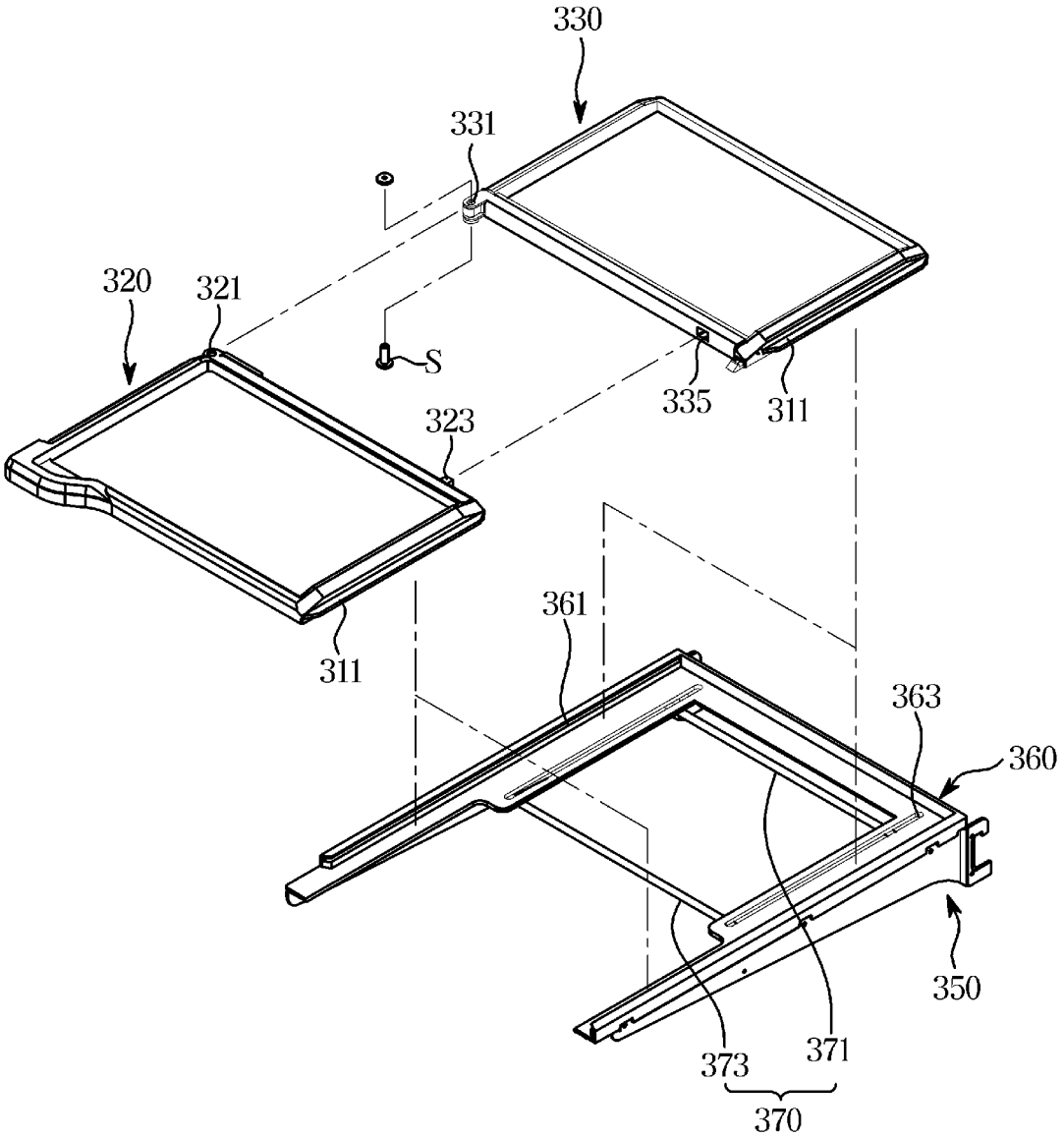
FIG. 24 is an exploded perspective view of a shelf unit, according to other embodiment of the disclosure.
Figure 25:
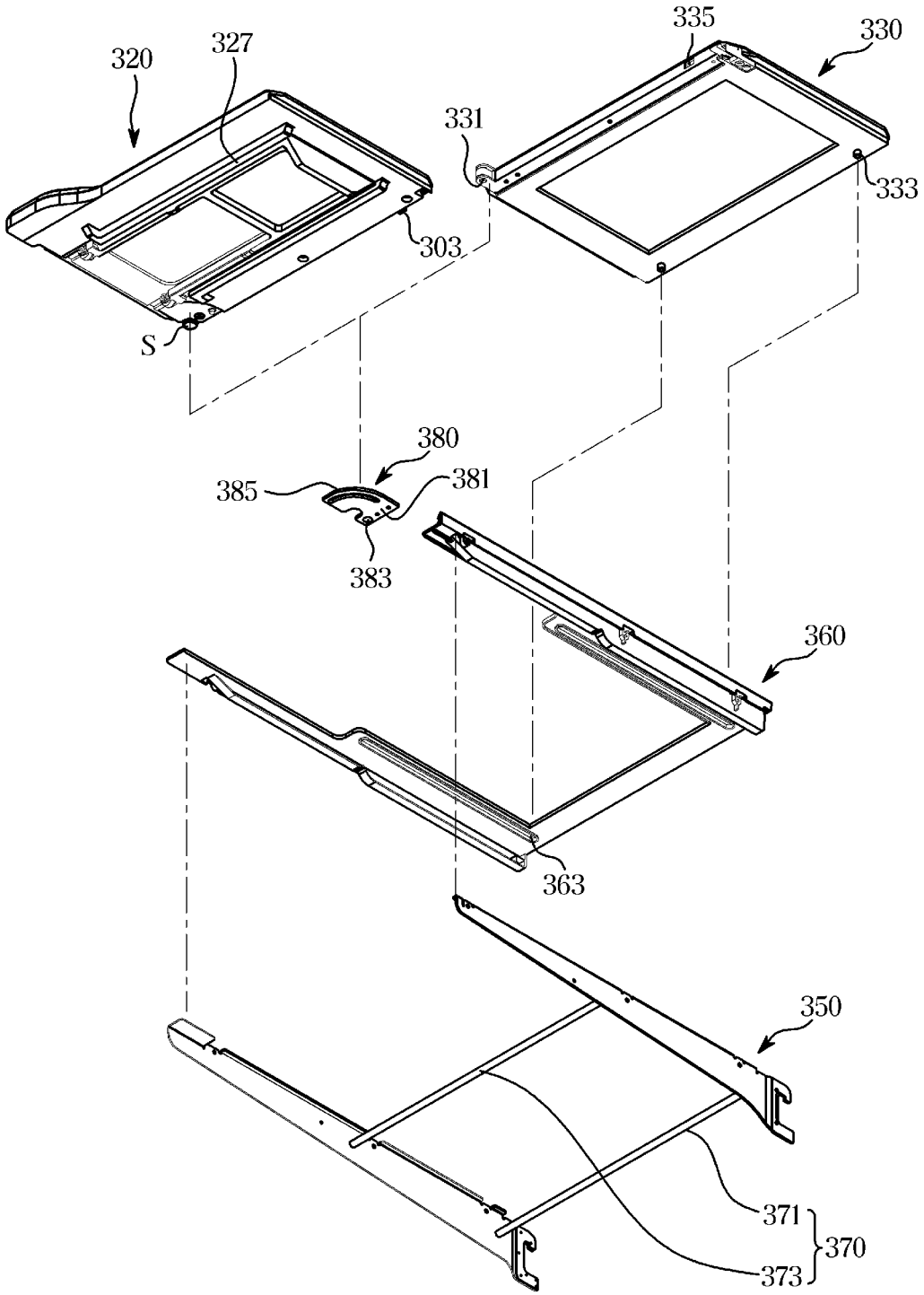
FIG. 25 shows a shelf unit with a guide member and a guide unit separated therefrom, according to another embodiment of the disclosure.
Figure 26:
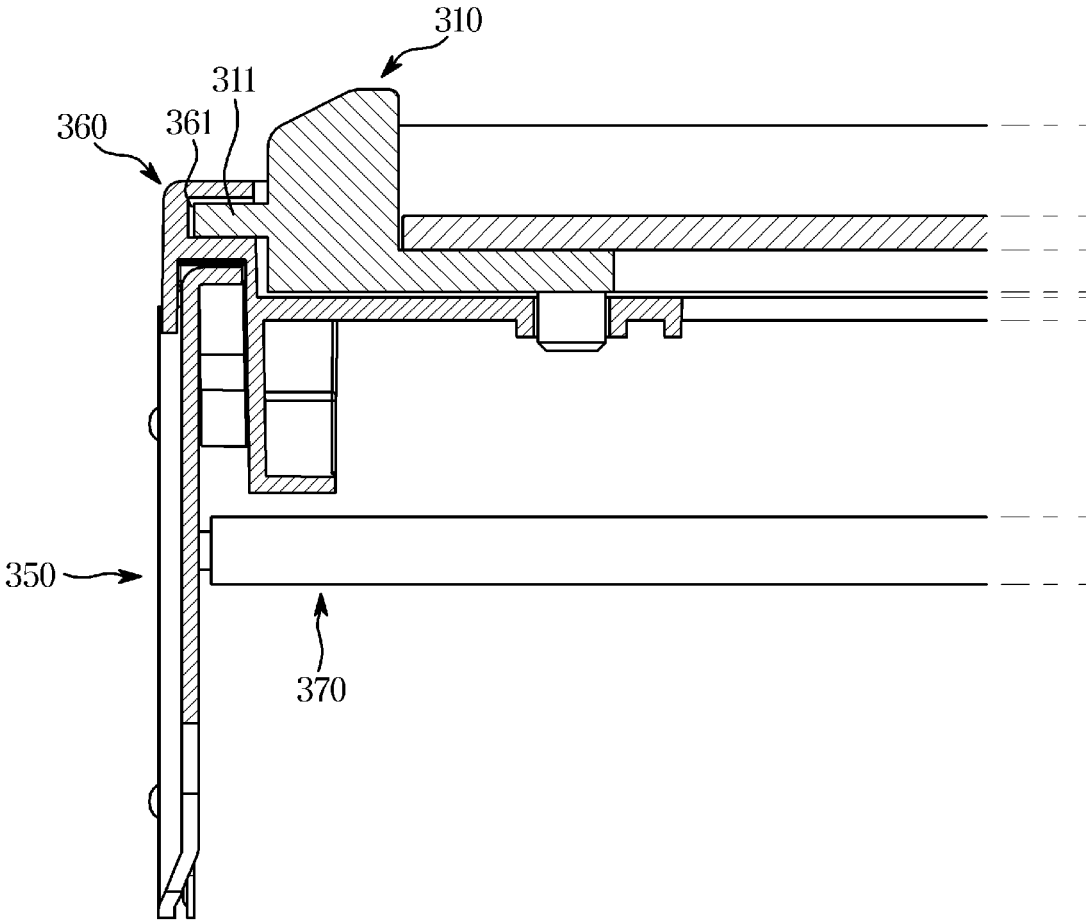
FIG. 26 is a cross-sectional view of a portion of a shelf unit, according to another embodiment of the disclosure.

FIG. 22 is a perspective view of a shelf unit, according to another embodiment of the disclosure, FIG. 23 is a plan view of the bottom of a shelf unit, according to another embodiment of the disclosure, FIG. 24 is an exploded perspective view of a shelf unit, according to another embodiment of the disclosure, FIG. 25 shows a shelf unit with a guide member and a guide unit separated therefrom, according to another embodiment of the disclosure, and FIG. 26 is a cross-sectional view of a portion of a shelf unit, according to another embodiment of the disclosure.

Referring to FIGS. 22 to 26, a shelf unit 300 may include a shelf 310 arranged in the storage chamber 20, and brackets 350 coupled onto either side of the shelf 310 to support the shelf 310.

The shelf 310 may include a first shelf 320 arranged on a front right in the storage chamber 20, a second shelf 330 arranged behind the first shelf 320, and a third shelf 340 arranged on the left in the storage chamber 20.

Brackets 350 may be coupled onto either side of the first and second shelves 320 and 330 and onto either side of the third shelf 340, in which case the bracket 350 coupled onto the right side of the first and second shelves 320 and 330 may be fixed to an inner wall of the storage chamber 20. The bracket 350 coupled onto the left side of the third shelf 340 may be fixed to an inner wall of the storage chamber 20.

The first and second shelves 320 and 330 may be moved forward or backward, allowing the user to easily take out a food item on the first and second shelves 320 and 330.

The brackets 350 coupled onto either side of the first and second shelves 320 and 330 may include a guide member 360 for guiding the first and second shelves 320 and 330 to be moved forward or backward.

The guide member 360 may include sliding rails 361 for guiding the first and second shelves 320 and 330 to be moved forward or backward. The first and second shelves 320 and 330 may include sliding guides 311 arranged on either side of the first and second shelves 320 and 330 to be moved forward or backward along the sliding rails 361 arranged in the guide member 360. The sliding guides 311 of the first and second shelves 320 and 330 may be received in the sliding rails 361 arranged in the guide member 360, and the first and second shelves 330 may be moved forward or backward by the sliding guides 311 that are moved forward or backward along the sliding rails 361.

The first shelf 320 may be rotationally coupled to the second shelf 330. A first rotation hole 321 may be arranged on the rear left of the first shelf 320, and a second rotation hole 331 may be arranged on the front left of the second shelf 330 coupled with the first shelf 320. The first and second shelves 320 and 330 may be coupled to be rotated by a rotation shaft S rotationally inserted to the first and second rotation holes 321 and 331.

The second shelf 330 may include stopper projections 333 arranged to protrude from bottom of a rear portion of the second shelf 330. The guide member 360 may include stopper projection guide holes 363 for receiving the stopper projections and guiding the stopper projections 333 to be moved back and forth. The stopper projection guide holes 363 may limit a distance moved forward by the first shelf 320 while guiding the stopper projections 333 to be moved back and forth. The stopper projection 333 moved along the stopper projection guide hole 363 may be moved forward until reaching the end of the stopper projection guide hole 363. Once the stopper projection 333 arrives at the end of the stopper projection guide hole 363 where the stopper projection 333 is not able to move further forward, the first shelf 320 may be in a position to be freely rotated around the rotation shaft S.

A pair of connecting rods 370 may be provided between the pair of brackets 350 coupled onto either side of the first and second shelves 320 and 330. The pair of connecting rods 370 may prevent twisting of the first and second shelves 320 and 330 when the first and second shelves 320 and 330 is moved forward or backward. The pair of connecting rods 370 may include a first connecting rod 371 coupled onto back portions of the pair of brackets 350 and a second connecting rod 373 coupled to the pair of brackets 240 in front of the first connecting rod 371.

The first shelf 320 may include a fixing projection 323 arranged at the rear end of the first shelf 320 to have the first shelf 320 fixed to the second shelf 330. The second shelf 330 may include a first shelf fixing groove 335 arranged at the front end of the second shelf 330 to receive and fix the fixing projection 323 to the second shelf 330.

The shelf unit 300 may include a guide unit 380 for guiding the first shelf 320 to be rotated around the rotation shaft S. The guide unit 380 may include the rotation shaft S for the first shelf 320 to be rotationally coupled with the second shelf 330, a coupler 381 coupled onto the bottom of a front portion of the second shelf 330, a receiver 383 to rotationally receive the rotation shaft S, and a guide hole 385 to guide the first shelf 320 to be rotated around the rotation shaft S. Of the guide unit 380, other parts than the coupler 381 may be placed on the bottom of a rear portion of the first shelf 320. On the bottom of the rear portion of the first shelf 320 where the other parts of the guide unit 380 than the coupler 381, there may be a guide projection 325 guided along the guide hole 385 for the first shelf 320 to be rotated around the rotation shaft S.

The first shelf 320 may include a fixing member 327 for fixing the first shelf 320 after the first shelf 320 is rotated around the rotation shaft S. The fixing member 327 may be arranged on the bottom of the first shelf 320 to be moved back and forth. At the front end of the third shelf 340 with which the first shelf 320 comes into contact after the first shelf 320 is rotated around the rotation axis 5, there may be a fixing member fixing groove 341 to which the fixing member 327 is inserted and fixed.

Figure 27:
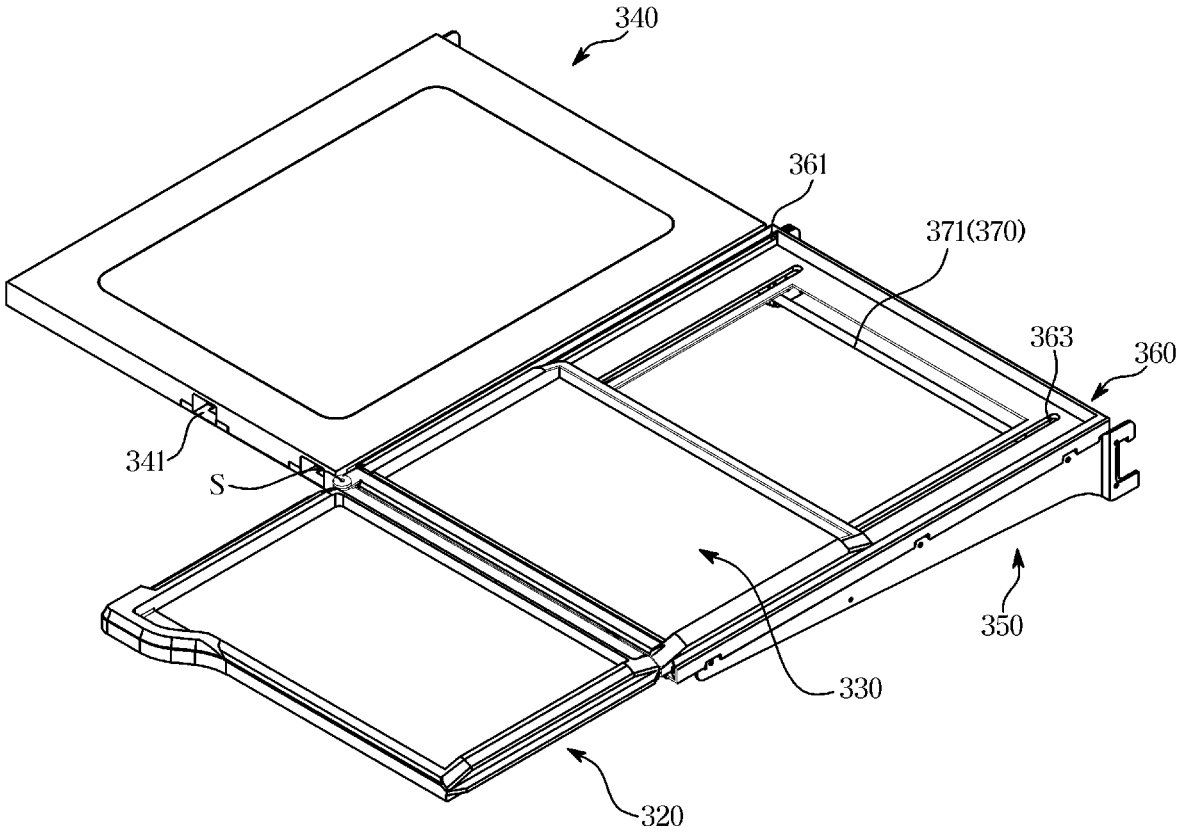
FIG. 27 shows a shelf unit with first and second shelves moved forward, according to another embodiment of the disclosure.
Figure 28:
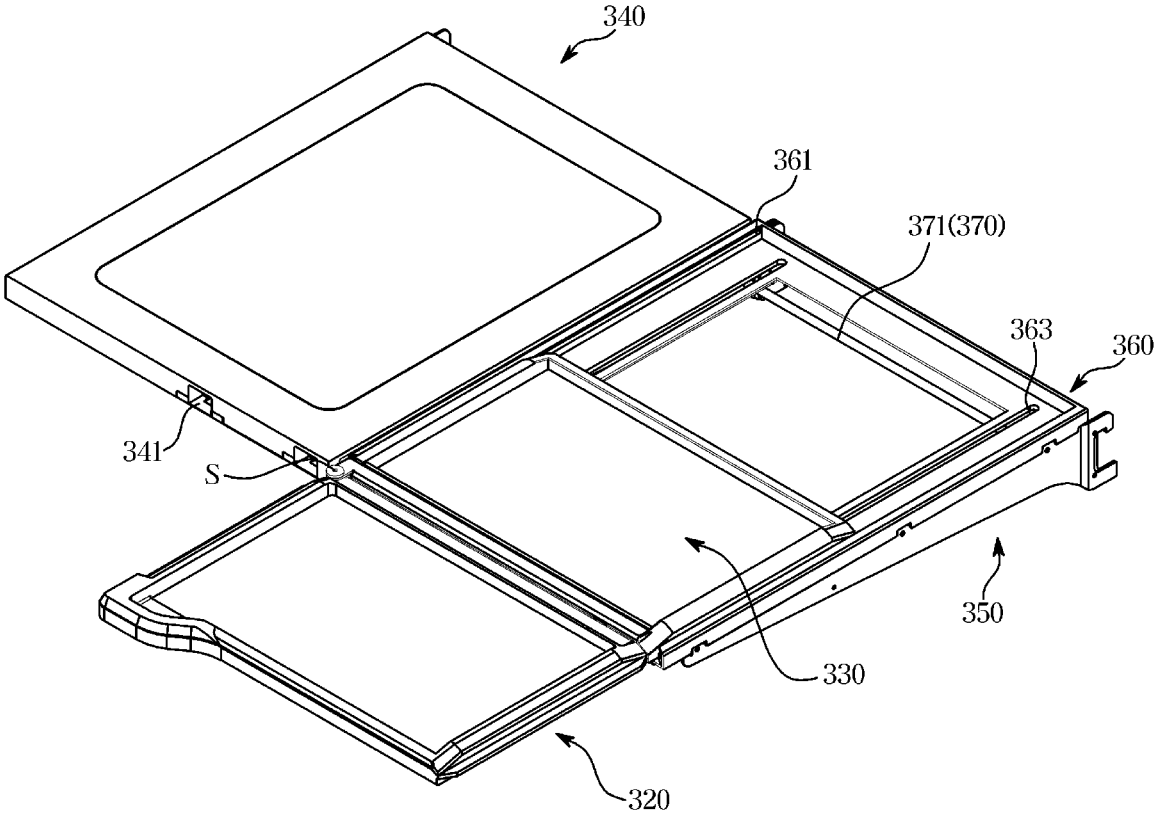
FIG. 28 is a plan view of the bottom of a shelf unit with first and second shelves moved forward, according to another embodiment of the disclosure.

FIG. 27 shows a shelf unit with first and second shelves moved forward, according to another embodiment of the disclosure, and FIG. 28 is a plan view of the bottom of a shelf unit with first and second shelves moved forward, according to another embodiment of the disclosure.

Referring to FIGS. 27 and 28, the first and second shelves 320 and 330 may be moved forward with the aid of the sliding rails 361 arranged in the guide member 360 and sliding guides 311 arranged on either side of the first and second shelves 320 and 330 (also see FIG. 26).

When the first and second shelves 320 and 330 are moved forward, the stopper projection 333 is moved to the end of the stopper projection guide hole 363 and stopped at the end, thereby limiting the distance moved forward by the first and second shelves 320 and 330. When the first and second shelves 320 and 330 are moved forward as far as the distance limited by the stopper projection 333 and the stopper projection guide hole 363, the first shelf 320 may be in a position to be freely rotated around the rotation shaft S.

Figure 29:
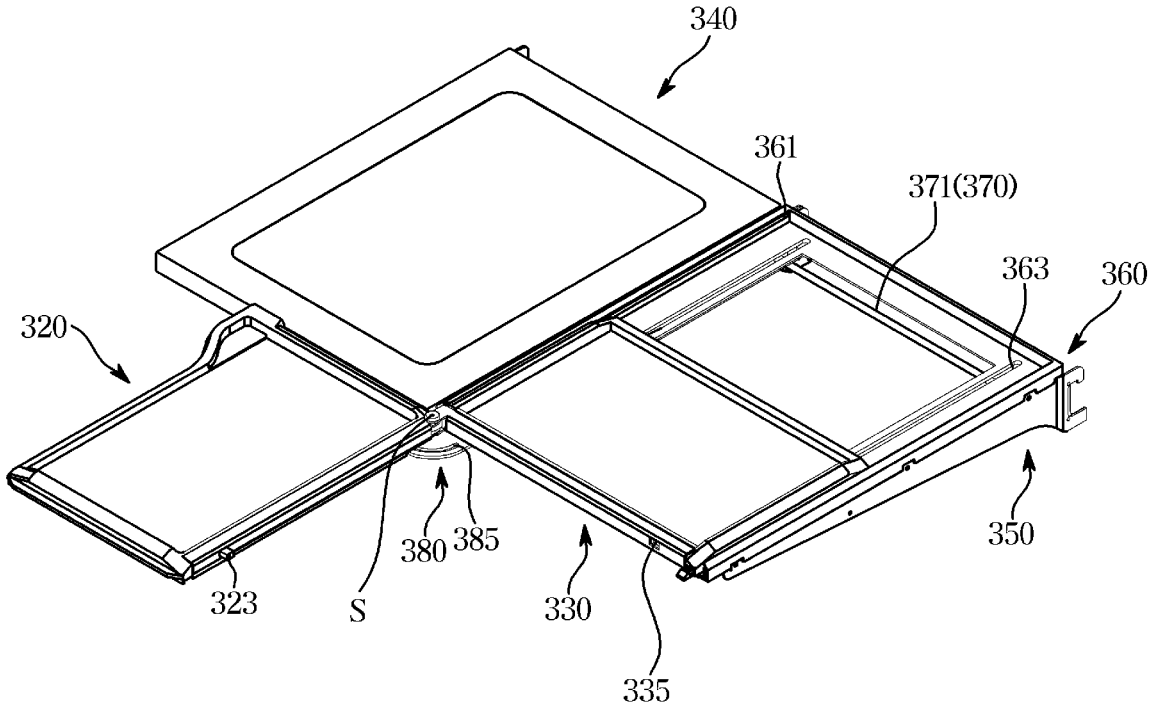
FIG. 29 shows a first shelf moved forward and rotated around a rotation shaft, according to another embodiment of the disclosure.
Figure 30:
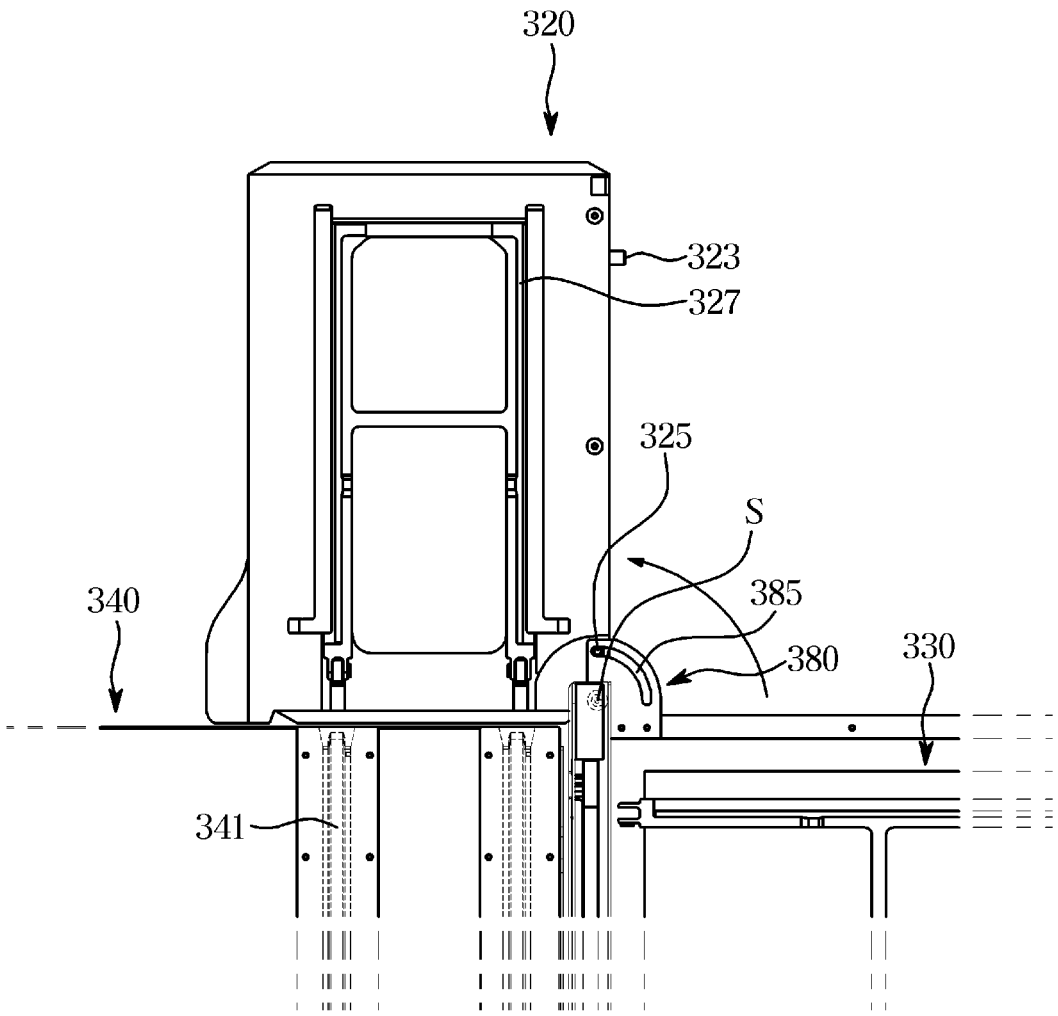
FIG. 30 is a plan view of the bottom of a shelf unit a first shelf moved forward and rotated around a rotation shaft, according to another embodiment of the disclosure.
Figure 31:
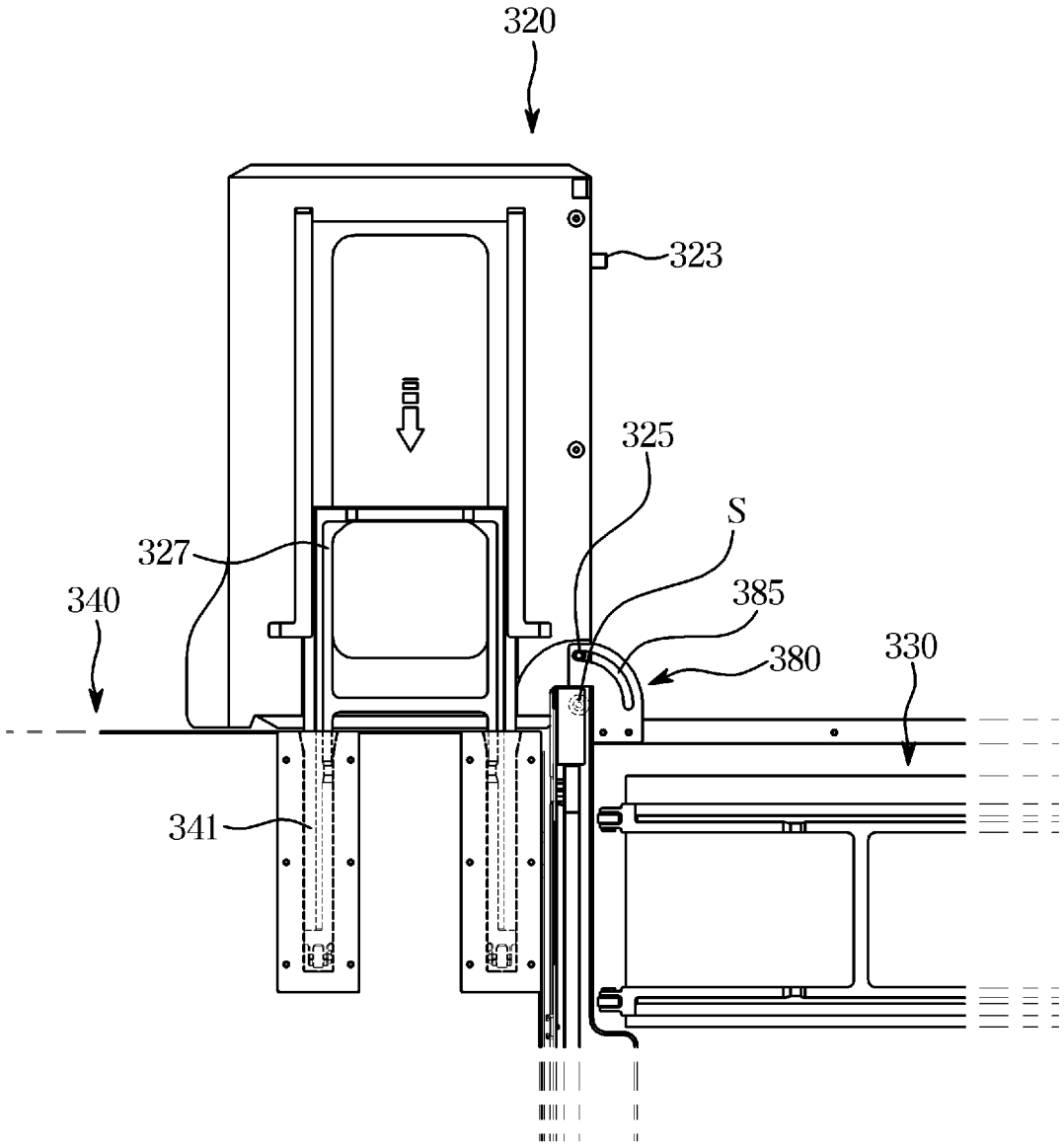
FIG. 31 shows a first shelf rotated and then fixed by a fixing member, according to another embodiment of the disclosure.

FIG. 29 shows a first shelf moved forward and rotated around a rotation shaft, according to another embodiment of the disclosure, FIG. 30 is a plan view of the bottom of a shelf unit with a first shelf moved forward and rotated around a rotation shaft, according to another embodiment of the disclosure, and FIG. 31 shows a first shelf rotated and then fixed by a fixing member, according to another embodiment of the disclosure.

Referring to FIGS. 29 and 30, the first shelf 320 moved forward may be rotated around the rotation shaft S with the aid of the guide unit 380. When the first shelf 320 is rotated around the rotation shaft S, the guide projection 325 of the first shelf 320 may be guided along the guide hole 385.

FIG. 31 shows a first shelf rotated and then fixed by a fixing member inserted to a fixing member fixing groove, according to another embodiment of the disclosure.

Referring to FIG. 31, after the first shelf 320 is rotated by the guide unit 380 around the rotation shaft S, the fixing member 327 may be inserted to the fixing member fixing groove 341 by pulling the fixing member 327 backward. Once the first shelf 320 is fixed, the user may easily reach and take out a food item stacked and stored on the second shelf 230.

According to embodiments of the disclosure, accessibility to shelves may be improved.

Several embodiments have been described above, but a person of ordinary skill in the art will understand and appreciate that various modifications can be made without departing the scope of the present disclosure. Thus, it will be apparent to those ordinary skilled in the art that the true scope of technical protection is only defined by the following claims.

What is claimed is:

1. A refrigerator comprising:

a main body; and a storage chamber provided inside the main body to accommodate a shelf unit, wherein the shelf unit includes:

a first shelf arranged in a front portion of the storage chamber and moveable along a forward direction relative to the storage chamber, a second shelf arranged behind the first shelf and moveable along the forward direction relative to the storage chamber, and a guide unit arranged to guide the first shelf, the guide formed to allow the first shelf which has been moved along the forward direction together with the second shelf, to be linearly moved away from the second shelf along a lateral direction relative to the second shelf, wherein the shelf unit comprises:

a pair of supporting members coupled onto either side on a bottom of the second shelf to support the first shelf and the second shelf, and moveable in the forward direction along with the first shelf and the second shelf, wherein the pair of supporting members are a pair of first supporting members and the shelf unit comprises:

a plurality of second supporting members coupled onto a bottom of the first shelf to support the first shelf, and moveable in the lateral direction along with the first shelf, wherein the guide unit comprises:

guides coupled onto a top surface of a back of the plurality of second supporting members, and guide rails respectively arranged on the bottom of a front portion of the first shelf and a bottom of a front portion of the second shelf to guide the guides to be moved along the lateral direction.

2. The refrigerator of claim 1, wherein a guide rail among the guide rails that is arranged at the first shelf comprises a catching bar arranged in a center portion of the guide rail of the first shelf to limit a distance moved by a guide among the guides along the lateral direction.

3. The refrigerator of claim 2, wherein the shelf unit comprises a pair of brackets and at least one bracket from among the pair of brackets comprises:

a guide to guide the first shelf and the second shelf to be moved along the forward direction, and the first shelf and the second shelf comprise guide rails arranged on either side of the first shelf and the second shelf for the guide to be moved along the forward direction.

4. The refrigerator of claim 1, wherein the shelf unit comprises:

a pair of brackets coupled on either side of the first shelf and the second shelf to support the first shelf and the second shelf, and a pair of connecting rods coupled between the pair of brackets to prevent twisting of the first shelf and the second shelf.

5. The refrigerator of claim 4, wherein the pair of connecting rods comprises a first connecting rod coupled to back portions of the pair of brackets, and a second connecting rod coupled to center portions of the pair of brackets.

6. The refrigerator of claim 5, wherein the pair of first supporting members are coupled with respective stoppers, the stoppers limiting a distance moved along the forward direction by the first shelf and the second shelf by being caught by the second connecting rod, so as for the first shelf to be moved along the lateral direction.

7. The refrigerator of claim 6, wherein at least one bracket from among the pair of brackets comprises:

a sliding guide to guide the first shelf and the second shelf to be moved along the forward direction, and the first shelf and the second shelf comprise sliding rails arranged on either side of the first shelf and the second shelf to be moved along the forward direction with the sliding guide.

* * * * *